US009140032B2

(12) United States Patent
Lin

(10) Patent No.: US 9,140,032 B2
(45) Date of Patent: Sep. 22, 2015

(54) DOOR LOCK

(71) Applicant: Chung-Liang Lin, Tainan (TW)

(72) Inventor: Chung-Liang Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 554 days.

(21) Appl. No.: 13/653,446

(22) Filed: Oct. 17, 2012

(65) Prior Publication Data

US 2014/0102155 A1 Apr. 17, 2014

(51) Int. Cl.

| | |
|---|---|
| ***E05B 65/10*** | (2006.01) |
| ***E05B 17/00*** | (2006.01) |
| ***E05C 9/04*** | (2006.01) |

(52) U.S. Cl.

CPC ..... *E05B 17/0066* (2013.01); *E05B 65/1006* (2013.01); *E05B 65/1053* (2013.01); *E05C 9/046* (2013.01); *E05C 9/048* (2013.01); *Y10T 70/5159* (2015.04)

(58) Field of Classification Search

CPC . E05B 13/002; E05B 13/004; E05B 17/0066; E05B 65/10; E05B 65/1046; E05B 65/1006; E05B 65/1053; E05C 9/046; E05C 9/048; Y10T 70/5159

USPC ..... 70/92, 107–111, 422; 292/21, 92

See application file for complete search history.

(56) References Cited

U.S. PATENT DOCUMENTS

| | | | | | |
|---|---|---|---|---|---|
| 874,793 | A * | 12/1907 | Robinson | 292/93 |
| 2,651,193 | A * | 9/1953 | Welch | 70/211 |
| 2,919,570 | A * | 1/1960 | Crew | 70/211 |
| 2,962,889 | A * | 12/1960 | McConnell | 70/92 |
| 4,145,900 | A * | 3/1979 | Ohno | 70/92 |
| 4,276,760 | A * | 7/1981 | Nolin | 70/107 |
| 4,418,552 | A * | 12/1983 | Nolin | 70/107 |
| 5,658,026 | A * | 8/1997 | Nigro et al. | 292/336.3 |
| 7,634,927 | B1 * | 12/2009 | Tien | 70/92 |
| 8,590,948 | B2 * | 11/2013 | Shen | 292/336.3 |
| 8,826,705 | B2 * | 9/2014 | Tien | 70/92 |
| 2011/0248518 | A1 * | 10/2011 | Tien | 292/336.3 |
| 2012/0175892 | A1 * | 7/2012 | Shen | 292/92 |

* cited by examiner

*Primary Examiner* — Lloyd Gall

(74) *Attorney, Agent, or Firm* — Alan D. Kamrath; Kamrath IP Lawfirm, P.A.

(57) ABSTRACT

A door lock (3) includes a latch device (30) and an inner operational device (20) mounted to a first side (1A) of a door (1) and an outer operational device (16) mounted to a second side (1B) of the door (1). The inner and outer operational devices (20, 16) can be operated to retract a latch (38) of a latch device (30) from an extended, latching position to a retracted, unlatching position. A tooth (223) on an actuator (219) of the outer operational device (16) breaks if a large force is applied to a handle (197). A spindle (191) pivots freely without moving the latch (38), preventing damage to components of the outer operational device (16) and the latch device (30). A base (811) of the latch device (30) can be comprised of first, second, and third plates (813, 847, 883) to allow sheet metal processing without sacrificing structural strength.

4 Claims, 29 Drawing Sheets

DOOR LOCK

BACKGROUND OF THE INVENTION

The present invention relates to a door lock and, more particularly, to a door lock mounted on a panic exit door or a passageway door, wherein the door lock can be manufactured at a higher speed while avoiding damage to the components of the door lock resulting from forcible rotation of an outer handle of the door lock in a locking state.

A passageway door lock is generally mounted to a fireproof door or a passageway door in buildings and is generally in a state allowing easy passage. The passageway door lock generally includes a press bar that can be pressed to retract a latch of a latch device for unlatching the door. Components of the latch device are mounted to a base formed by sheet metal processing. However, the base must have an area and structural strength sufficient for bending for formation purposes. Larger bases increase the costs for storage and transport. Although smaller bases can be formed by casting or lathes, yet casting requires molds and lathing is slow.

The passageway door lock can further include an outer operational device for preventing unauthorized access. However, the components of the outer operational device are liable to be damaged if a handle of the outer operational device is forcibly rotated while the lock is in a locking state.

Thus, a need exists for a novel door lock that mitigates and/or obviates the above disadvantages.

BRIEF SUMMARY OF THE INVENTION

The present invention fulfils the above need by providing a door lock including a latch device adapted to be fixed to a side of a door. The latch device includes a latch pivotable about a first axis between an extended, latching position and a retracted, unlatching position. When the door is in a closed position and the latch is in the extended, latching position, the door is retained in the closed position. When the door is in the closed position and the latch is in the retracted, unlatching position, the door is moveable from the closed position to an open position. The door lock further includes a housing having an end face defining a space. The space includes a bottom wall on which a receiving portion is formed on the bottom wall. A receiving hole is defined in the receiving portion and in communication with the space and an outside. The housing further includes first and second pegs and an engagement hole. The first peg is located between the second peg and the engagement hole along the first axis. The housing is adapted to be mounted to the door. The end face of the housing is adapted to abut a second side of the door opposite to the first side of the door.

A cylinder is mounted in the receiving hole of the receiving portion. The cylinder includes an actuating plate rotatably received in the space of the housing. A spindle is pivotably received in the engagement hole of the housing and includes an engagement end received in the space of the housing. A handle is mounted to the spindle and located outside of the housing and pivotable between a first position and a second position, with the spindle pivoting jointly with the handle.

A push block is pivotably connected to the spindle and includes a peripheral wall having a positioning groove. The push block further includes two push portions formed on an outer periphery thereof, with the positioning groove located between the two push portions in a circumferential direction about a pivot axis of the spindle. Each push portion includes upper and lower ends spaced from each other along the first axis. A connection hole extends from a side through the other side of the push block and includes an inner periphery having an insertion groove. The engagement end of the spindle is pivotably received in the connection hole of the push block.

An actuator is coupled to and pivotable together with the spindle. An actuation hole extends from a side through the other side of the actuator. A tooth is formed on the other side of the actuator and engaged in the insertion groove of the push block. The engagement end of the spindle is engaged with the actuation hole of the actuator, with the spindle pivotable together with the actuator.

A positioning block is received in the space of the housing and movable between an upper position and a lower position along the first axis. The positioning block includes upper and lower ends spaced from each other along the first axis. The upper end of the positioning block includes a coupling portion. The lower end of the positioning block has a positioning portion. When the handle is in the first position, the positioning portion of the positioning block is aligned with the positioning groove of the push block along the first axis.

An actuating member is pivotably received in the space of the housing and includes a pivotal portion pivotably connected to the second peg of the housing. The actuating member further includes an engagement plate pivotably engaged with the coupling portion of the positioning block. First and second stops are formed on two sides of the pivotal portion. The actuating plate of the cylinder presses against one of the first and second stops when the actuating plate pivots.

A movable block is slideably received in the space of the housing and includes first and second surfaces spaced from each other. The movable block further includes a lower surface extending between the first and second surfaces. A protrusion is formed on the second surface of the movable block and located adjacent to the lower surface of the movable block. The second surface abuts the positioning block. The protrusion is spaced from the positioning block along a second axis perpendicular to the first axis. The movable block is movable along the first axis between a releasing position and a pressing position. When the movable block is in the releasing position, the lower surface of the movable block abuts the upper end of each push portion of the push block.

A sleeve is pivotably connected to the housing and includes a first end pivotably connected to the first peg of the housing and a second end. The sleeve further includes an arm formed on an outer periphery of the sleeve. The arm has a distal end abutting the protrusion of the movable block. When the movable block moves, the protrusion of the movable block presses against the arm of the sleeve, causing pivotal movement of the sleeve about a pivot axis defined by the first peg.

A follower rod is coupled to the second end of the sleeve and is pivotable together with the sleeve. The follower rod includes an end connected to and movable with the latch device. The latch pivots between the extended, latching position and the retracted, unlatching position when the follower rod pivots.

When the actuating plate of the cylinder pivots and presses against the first stop of the actuating member, the actuating member moves jointly with the positioning block from the lower position to the upper position.

When the positioning block is in the upper position, if the actuating plate of the cylinder pivots and presses against the second stop of the actuating member, the actuating member moves jointly with the positioning block from the upper position to the lower position.

When the positioning block is in the lower position and when the handle is in the first position, the positioning portion of the positioning block is engaged with the positioning groove of the push block, preventing the push block from pivoting from the first position to the second position, avoiding the latch from moving from the extended, latching position to the retracted, unlatching position.

When the positioning block is in the upper position, the positioning portion of the positioning block is disengaged from the positioning groove of the push block, and the handle is movable from the first position to the second position.

When the handle pivots from the first position to the second position, the tooth of the actuator presses against the push block, causing joint pivotal movement of the actuator and the push block. The upper end of one of the push portions of the push block presses against the lower surface of the movable block, moving the movable block from the releasing position to the pressing position. The protrusion of the movable block pushes the follower rod to pivot through transmission of the sleeve, the follower rod moves the latch from the extended, latching position to the retracted, unlatching position. When the handle is in the second position, the movable block is in the pressing position, and the latch is in the retracted, unlatching position.

When the positioning block is in the lower position, the positioning portion of the positioning block is engaged with the positioning groove of the push block. If the tooth breaks due to forcible pivotal movement of the handle, pivotal movement of the spindle causes pivotal movement of the actuator without moving the push block.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
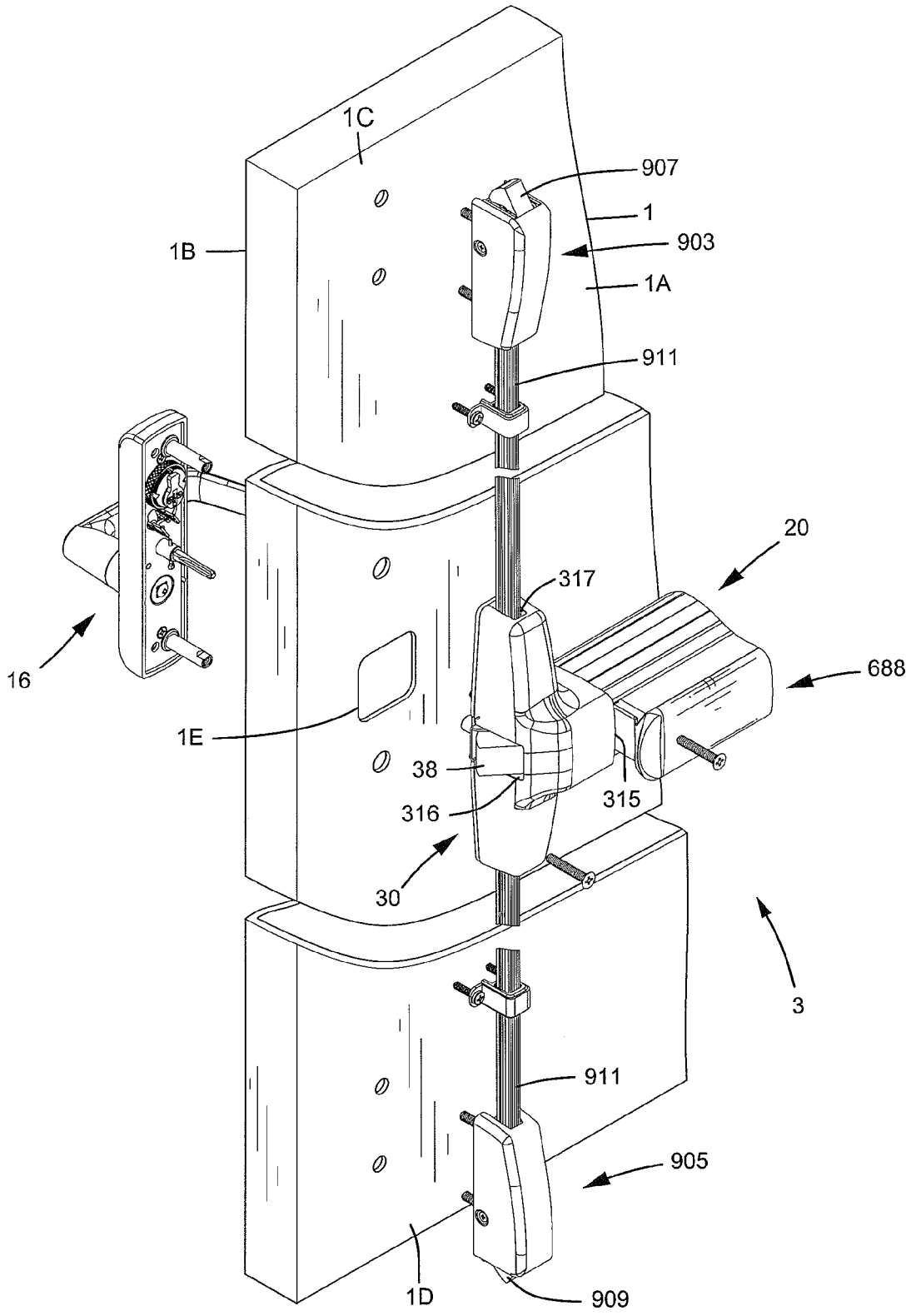
FIG. 1 shows a partial, perspective view of a door lock according to the present invention and a door to which the door lock is mounted.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "upper", "lower", "front", "rear", "inner", "outer", "end", "portion", "section", "longitudinal", "lateral", "inward", "leftward", "spacing", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 16:
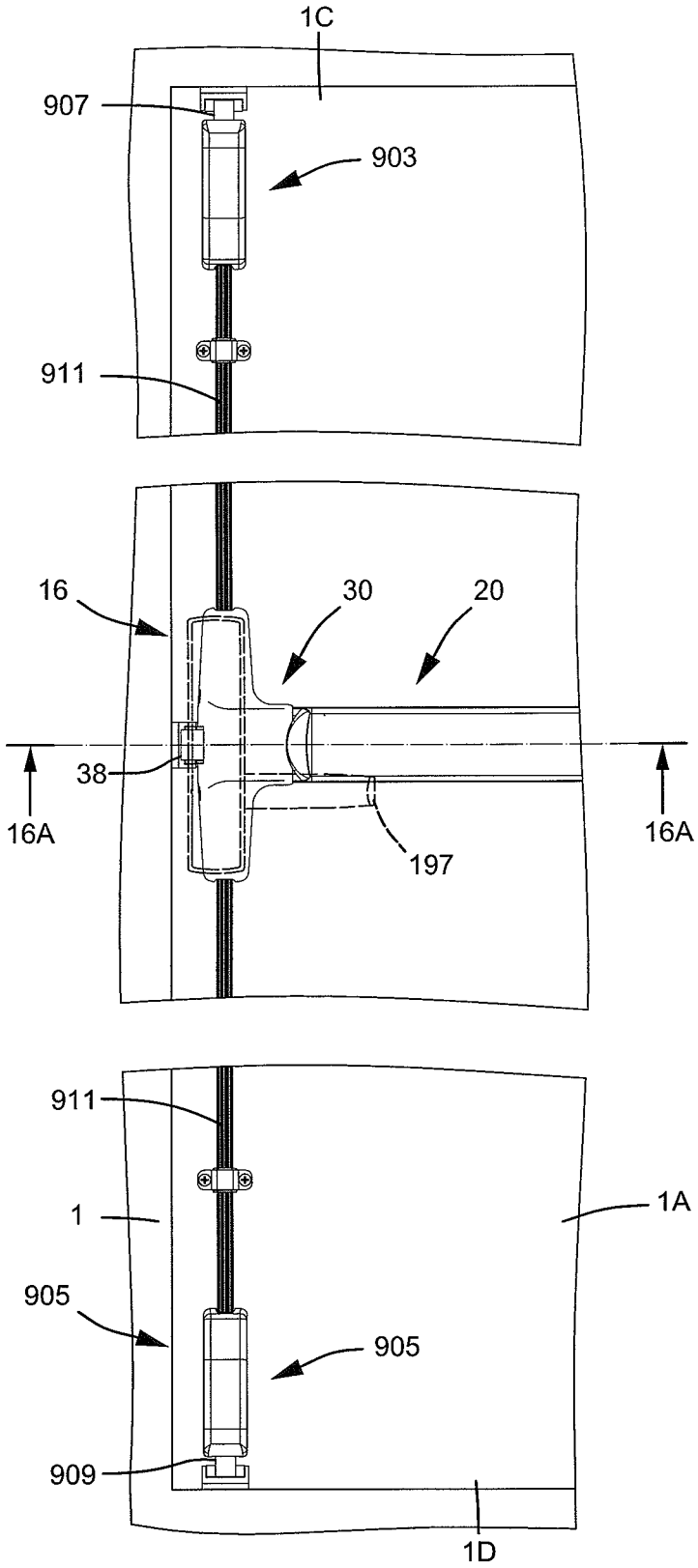
FIG. 16 shows a view similar to FIG. 2, with the door pivoted to a closed position.
Figure 16A:
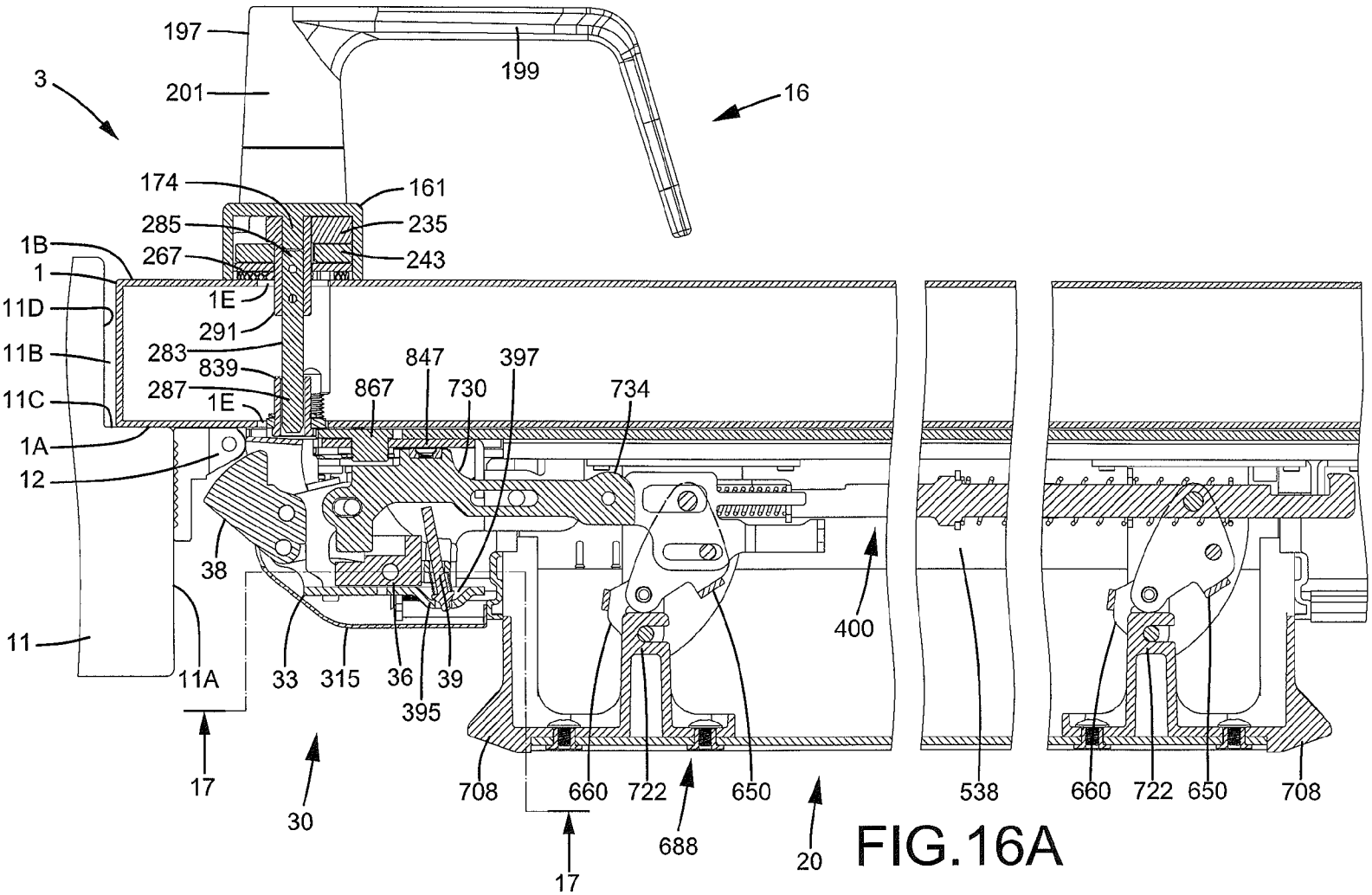
FIG. 16A shows a cross sectional view taken along section line 16A-16A of FIG. 16.

A door lock according to the present invention is shown in the drawings and generally designated 3. Door lock 3 includes a latch device 30 mounted to a door 1, an inner operational device 20, and an outer operational device 16 for operating latch device 30. Door 1 is pivotably mounted to a door frame 11 having rectangular or inverted U-shaped cross sections. Door frame 11 is fixed to a wall of a passageway and includes an inner face 11A and a stepped portion 11B. Stepped portion 11B includes an abutment face 11C extending perpendicularly from an edge of inner face 11A and a face 11D extending perpendicularly to abutment face 11C and parallel to and spaced from inner face 11A. Door 1 includes first and second sides 1A and 1B. Door 1 further includes an upper end 1C and a lower end 1D spaced from upper end 1C along a first axis X. Door 1 further includes a through-hole 1E defined in each of first and second sides 1A and 1B, with through-holes 1E spaced from each other along a second axis Y perpendicular to first axis X. An end of door 1 is pivotably mounted to door frame 11, and door 1 is movable between an open position (FIG. 3) and a closed position (FIG. 16A). When door 1 is in the closed position, first side 1A of door 1 abuts abutment face 11C of door frame 11 (FIG. 16A). An end face of the other end of door 1 adjacent to stepped portion 11B is spaced from abutment face 11C, allowing door 1 to pivot into or away from stepped portion 11B. A stop 12 is mounted to inner face 11A of door frame 11. Inner operational device 20 and latch device 30 are mounted to first side 1A. Outer operational device 16 is mounted to second side 1B.

According to the form shown, latch device 30 includes a base 811 fixed by bolts to first side 1A of door 1 and located adjacent to stop 12. Base 811 includes a first plate 813, a second plate 847, and two third plates 883. First, second, and third plates 813, 847, and 883 are formed by sheet metal processing. First plate 813 is fixed to first side 1A of door 1 and includes a first face 815 and a second face 817 spaced from first face 815 along a third axis Z perpendicular to first and second axis X and Y. First plate 813 further includes upper and lower portions 818 spaced from each other along first axis X. First plate 813 further includes a through-opening 832, two slots 819, and two through-holes 831, with each of through-opening 832, slots 819, and through-holes 831 extending from first face 815 through second face 817, with through-opening 832 located between upper and lower portions 818 along first axis X, with each slot 819 located in one of upper and lower portions 818, with each through-hole 831 located between through-opening 832 and one of slots 819 along first axis X. A pivotal portion 833 is located between upper and lower portions 818 and located at a side of through-opening 832. Pivotal portion 833 includes a shaft hole 837. Second face 817 of first plate 813 is located between first face 815 and an inner face 835 of pivotal portion 833. First plate 813 further includes two fixing holes 834, with each fixing hole 834 extending from first face 815 through second face 817.

Second plate 847 is fixed to first face 815 of first plate 813 and includes two wings 855 spaced along first axis X and an intermediate portion 854 between wings 855. Second plate 847 further includes first and second surfaces 849 and 851 spaced from each other along third axis Z. Second plate 847 further includes a knob hole 863, a notch 853, two through-holes 861, and two slots 857, with each of knob holes 863, notch 853, through-holes 861, and slots 857 extending from first surface 849 through second surface 851, with knob hole 863 located in the intermediate portion 854, with each slot 857 located in one of wings 855, with notch 853 located between wings 855. Each slot 857 has a tooth 859 on a wall thereof. Intermediate portion 854 further includes two legs 856 on an edge facing away from notch 853. Second plate 847 further includes two holes 865, with each hole 865 extending from first surface 849 through second surface 851. Second surface 851 of second plate 847 is mounted to and abuts first face 815 of first plate 813, with inner face 835 of pivotal portion 833 of first plate 813 spaced from second surface 851 of second plate 847 along third axis Z, with inner face 835 of pivotal portion 833 of first plate 813 aligned with notch 853 of second plate 847, with each slot 857 of second plate 847 aligned with one of slots 819 of first plate 813, with each through-hole 861 of second plate 847 aligned with one of through-holes 831 of first plate 813, with each hole 865 of second plate 847 aligned with one of fixing holes 834 of first plate 813.

Each third plate 883 includes a first side 885 and a second side 887 spaced from first side 885 along third axis Z. A tab 889 and two support plates 891 are formed on first side 885 of each third plate 883, with each support plate 891 having a movement groove 893. Second side 887 of each third plate 883 includes a retaining portion 897 having a first section 899 and a second section 901, with first section 899 having a retaining hole 904. Each third plate 883 further includes a pivot hole 895 extending from first side 885 through second side 887. Each third plate 883 is mounted to one of wings 855 of second plate 847, with second side 887 of each third plate 883 abutting first surface 849 of second plate 847, with retaining portion 897 of each third plate 883 engaged with one of slots 857 of second plate 847, with each tooth 859 of second plate 847 engaged in retaining hole 904 of one of third plate 883, with second section 901 of retaining portion 897 of each third plate 883 received in one of slots 819 of first plate 813, with pivotal hole 895 of each third plate 883 aligned with one of holes 865 of second plate 847.

Figure 8:
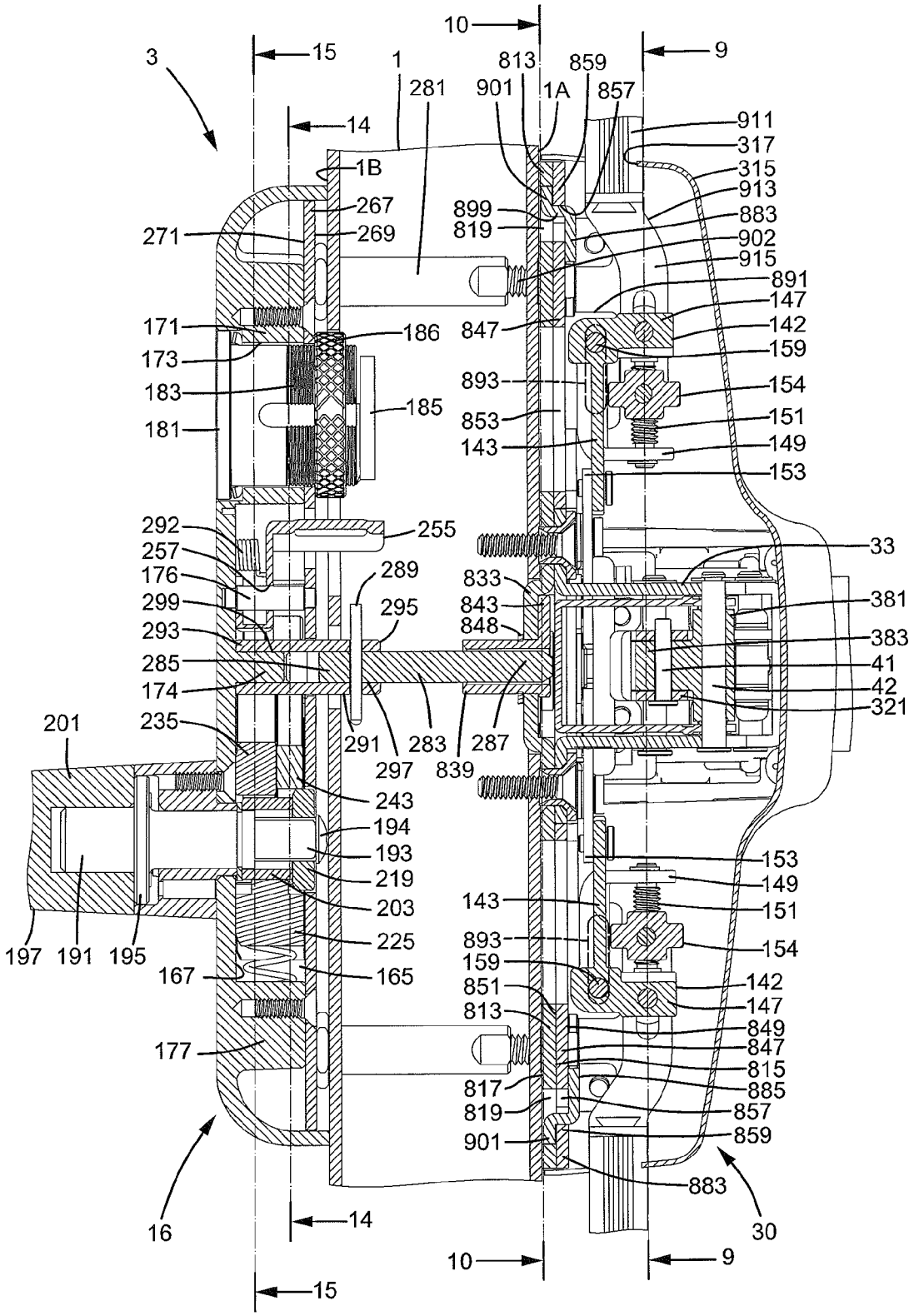
FIG. 8 shows a cross sectional view taken along section line 8-8 of FIG. 2.

Latch device 30 further includes a connecting member 839 pivotably mounted to first plate 813. Connecting member 839 includes a shaft 841 and a cam 843 on an outer periphery of shaft 841. Connecting member 839 further includes a connection hole 845 on an end face of shaft 841. Shaft 841 of connecting member 839 is pivotably received in shaft hole 837 of first plate 813, with cam 843 located between inner face 835 of pivotal portion 833 and first face 815 of first plate 813. A retainer 848 is mounted to shaft 841 of connecting member 839 and located on second face 817 of first plate 813, preventing connecting member 839 from disengaging from first plate 813 (FIG. 8).

Latch device 30 further includes a driving member 867 pivotably mounted to second plate 847. Driving member 867 includes a knob 869 having a non-circular driving end 871. A tail 873 extends from an outer periphery of knob 869. Knob 869 of driving member 867 is pivotably received in knob hole 863 of second plate 847. Tail 873 of driving member 867 is located between second surface 851 of second plate 847 and inner face 835 of pivotal portion 833 of first plate 813 and abuts cam 843 of connecting member 839. Driving end 871 of knob 869 extends beyond first surface 849 of second plate 847. When connecting member 839 pivots, cam 843 drives tail 873 of driving member 867, causing pivotal movement of driving member 867.

Latch device 30 further includes a follower 875 fixed to driving member 867. Driving member 867 includes a receiving portion 876 and two protruded portions 879 on an outer periphery of receiving portion 876, with receiving portion 876 having an actuation hole 877. Follower 875 is located on first surface 849 of second plate 847, with driving end 871 of knob 869 of driving member 867 engaged in actuation hole 877 of follower 875, allowing joint rotation of driving member 867 and follower 875 about a pivot axis defined by knob 869. A retainer 881 is mounted to driving end 871 of knob 869 and located at an outer side of follower 875, preventing follower 875 and driving member 867 from disengaging from second plate 847.

Latch device 30 further includes first and second sliding devices 14 respectively having first and second sliding blocks 142. Each of first and second sliding blocks 142 includes a seat 143 having a sliding groove 146. A pivotal block 147 and a support 149 are formed on a side of seat 143 of each of first and second sliding blocks 142, with support 149 located between sliding groove 146 and pivotal block 147. A pivot hole 145 extends from a lateral side through the other lateral side of each of first and second sliding blocks 142. Pivotal block 147 of each of first and second sliding blocks 142 includes an axial hole 148 extending along first axis X and aligned with a support hole 150 in support 149. First sliding block 142 is mounted between support plates 891 of an upper one of third plates 883. Second sliding block 142 is mounted between support plates 891 of a lower one of third plates 883. A mounting rod 159 extends through movement grooves 893 of upper third plate 883 and pivot hole 145 of first sliding block 142. Another mounting rod 159 extends through movement grooves 893 of lower third plate 883 and pivot hole 145 of second sliding block 142. Thus, each of first and second sliding blocks 142 is slideable along first axis X between support plates 891 of one of third plates 883.

Latch device 30 further includes two adjusting rods 151 and first and second adjusting blocks 154. Each adjusting rod 151 is pivotably received in axial hole 148 and support hole 150 of support 149 of one of first and second sliding blocks 142. First adjusting block 154 is located between pivotal block 147 and support 149 of first sliding block 142. Second adjusting block 154 is located between pivotal block 147 and support 149 of second sliding block 142. Each of first and second adjusting blocks 154 is threadedly engaged with one of adjusting rods 151. When each adjusting rod 151 rotates, each of first and second adjusting blocks 154 slides along first axis X between pivotal block 147 and support 149 of one of first and second sliding blocks 142.

Figure 9:
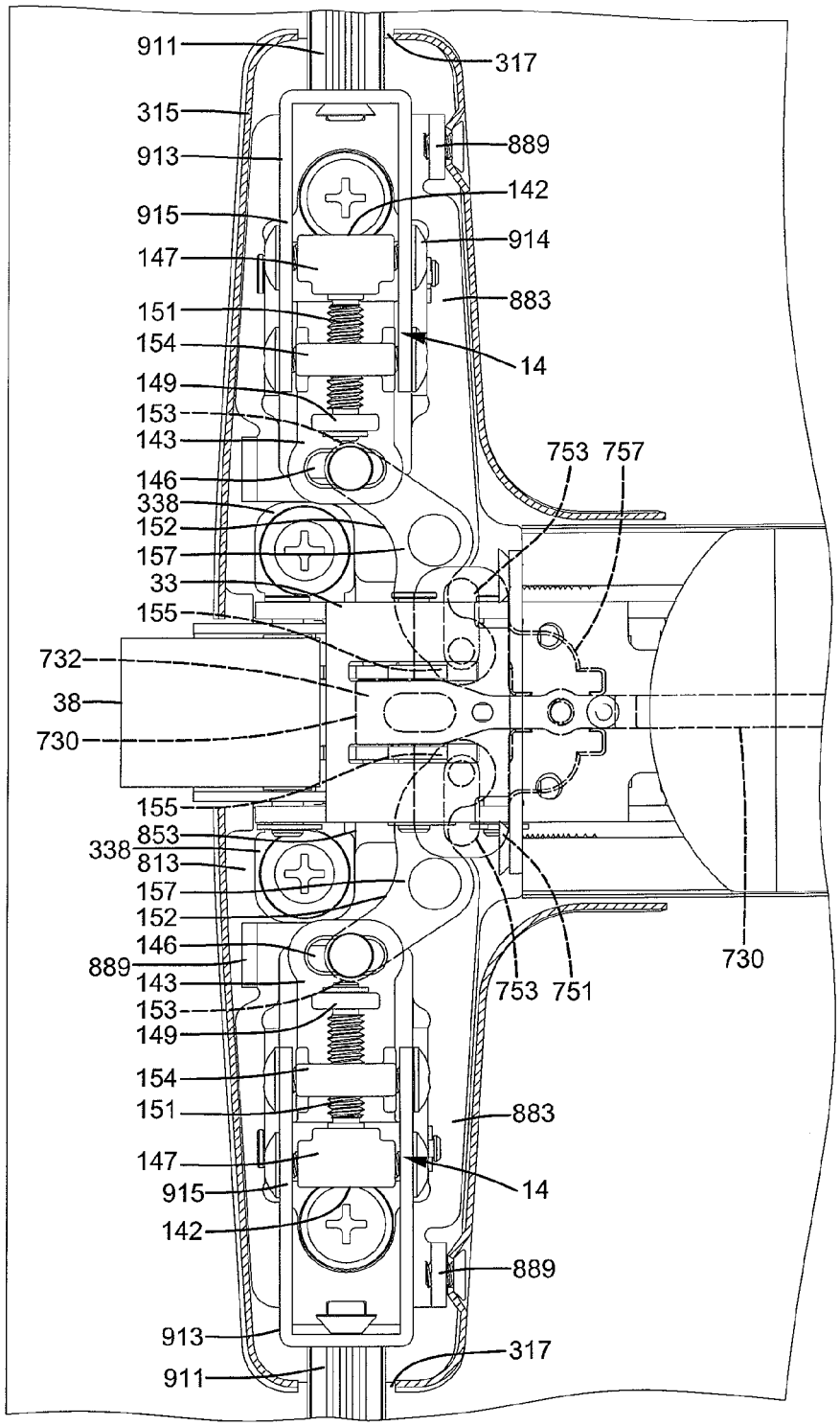
FIG. 9 shows a cross sectional view taken along section line 9-9 of FIG. 8.
Figure 10:
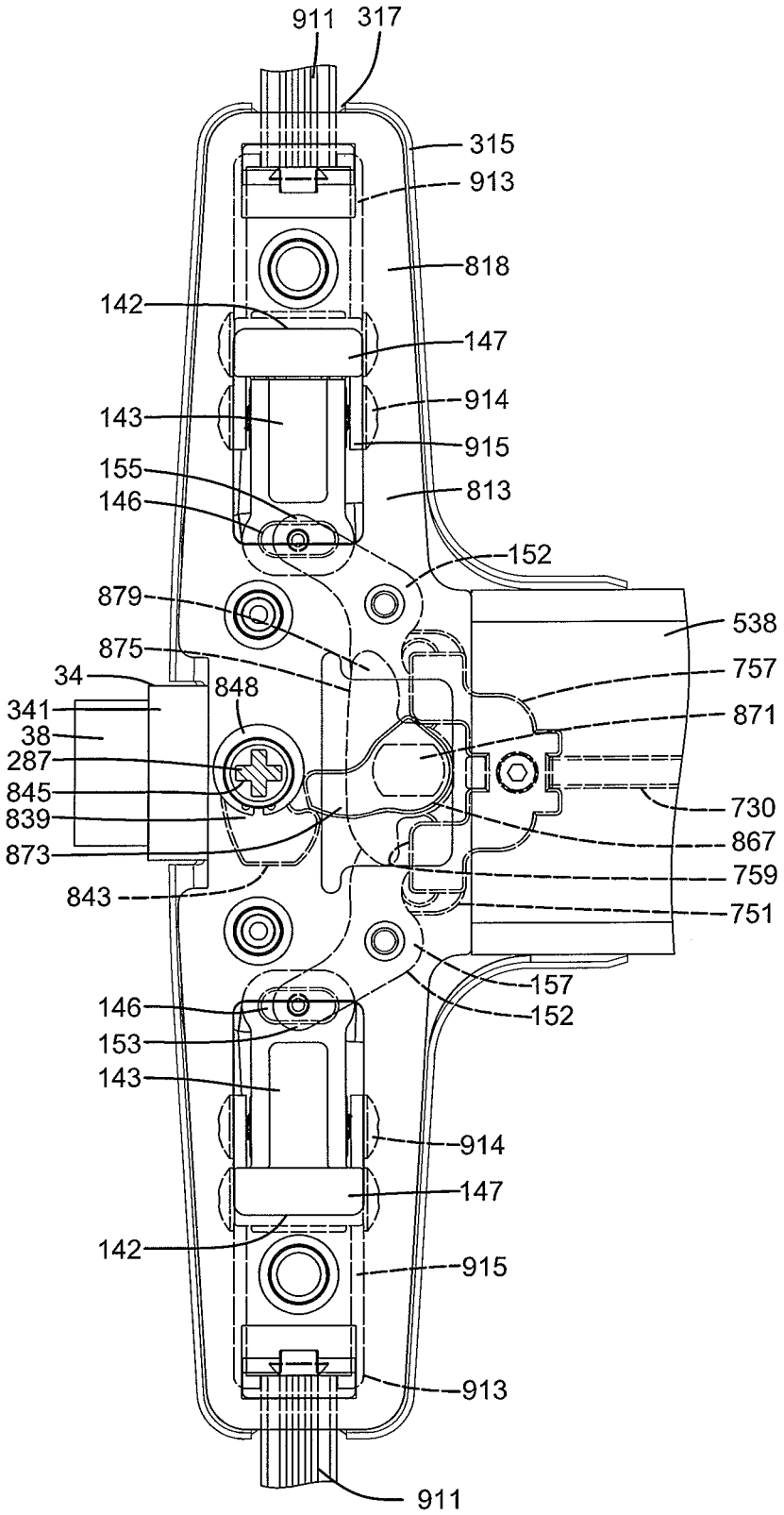
FIG. 10 shows a cross sectional view taken along section line 10-10 of FIG. 8.

Latch device 30 further includes first and second connecting arms 152 pivotably mounted to third plates 883. Each of first and second connecting arms 152 includes first and second pivotal ends 153 and 155 and a pivotal portion 157 between first and second pivotal ends 153 and 155. A first axle 158 is extended through pivotal portion 157 of each of first and second connecting arms 152, pivotal hole 895 of one of third plates 883, one of holes 865 of second plate 847, and one of fixing holes 834 of first plate 813. Thus, first, second, and third plates 813, 847, and 883 are connected together, with first and second connecting arms 152 pivotable relative to third plates 883. A second axle 160 is extended through first pivotal end 153 of first connecting arm 152 and sliding groove 146 of first sliding block 142, allowing sliding movement of first pivotal end 153 of first connecting arm 152 relative to first sliding block 142. Another second axle 160 is extended through first pivotal end 153 of second connecting arm 152 and sliding groove 146 of second sliding block 142, allowing sliding movement of first pivotal end 153 of second connecting arm 152 relative to second sliding block 142 (FIGS. 9 and 10). First and second sliding blocks 142 are moved when first and second connecting arms 152 pivot.

Door lock 3 further includes top and bottom latches 903 and 905 respectively coupled to first and second sliding devices 14. Top latch 903 is fixed to first side 1A of door 1 and located adjacent to upper end 1C. Bottom latch 905 is fixed to first side 1A of door 1 and located adjacent to lower end 1D. Top latch 903 includes a top latch head 907 and a first connecting rod 911 having an end connected to top latch head 907. Bottom latch 905 includes a bottom latch head 909 and a second connecting rod 911 having an end connected to bottom latch head 909. The other end of first connecting rod 911 is fixed to a first drawing member 913. The other end of second connecting rod 911 is fixed to a second drawing member 913. Each of first and second drawing members 913 has two legs 915. Legs 915 of first drawing member 913 are connected by screws 914 to first sliding block 142 and first adjusting block 154. Legs 915 of second drawing member 913 are connected by another screws 914 to second sliding block 142 and second adjusting block 154. When first and second sliding blocks 142 and first and second adjusting blocks 154 move along first axis X, top latch head 907 and bottom latch head 909 move toward each other (FIGS. 22 and 23) along first axis X.

Latch device 30 further includes a bracket 33 mounted to base 811 and having substantially U-shaped cross sections. Bracket 33 includes parallel, first and second sidewalls 331 spaced along first axis X. Bracket 33 further includes an interconnecting wall 336 interconnected between first and second sidewalls 331 and extending along first axis X. Each of first and second sidewalls 331 has a plurality of engaging portions 338. Each of first and second sidewalls 331 further includes first and second sections 332 and 333 spaced along second axis Y, with a shoulder 340 is formed at second ends 333. Aligned pin holes 335 are defined in first sections 332, and aligned holes 339 are defined in second sections 333. First and second sidewalls 331 further include aligned pin holes 330 intermediate holes 339 and pin holes 335. Furthermore, first and second sidewalls 331 include aligned slots 334 intermediate holes 339 and pin holes 335. Interconnecting wall 336 includes two guide slots 337 extending along second axis Y and spaced along first axis X. Interconnecting wall 336 further includes a bulged section 395 spaced from guide slots 337 along second axis Y. Bulged section 395 defines a cavity 397 in an inner face of interconnecting wall 336 and has a hole 396 extending along third axis Z. Each engagement portion 338 of bracket 33 abuts first face 815 of first plate 813 and is received in notch 853 of second plate 847 (FIG. 9). Fasteners 45 are extended through engaging portions 338 to fix bracket 33 to first plate 813 of base 811. Each leg 856 of second plate 847 abuts an inner face of shoulder 340 of bracket 33. Thus, screws can be extended through shoulder 340 into each leg 856 to fix bracket 33 to first plate 813.

Latch device 30 further includes a latch 38 having triangular cross sections. Specifically, latch 38 includes a first face 382 having first and second ends, an arcuate second face 385 having a first end interconnected to the first end of first face 382 and a second end, and a third face 386 having first and second ends interconnected to the second ends of the first and second faces 382 and 385. A pivotal portion 381 is formed at a corner between the second end of first face 382 and the first end of third face 386 and includes a pin hole 387 extending along first axis X. A latch pin 42 is extended through pin holes 335 of bracket 33 and pin hole 387 to pivotably connect latch 38 to bracket 33, allowing latch 38 to pivot between an extended, latching position outside bracket 33 (FIGS. 1-3) and a retracted, unlatching position inside bracket 33 (FIGS. 20 and 21) about a pivot axis defined by latch pin 42 extending along first axis X. First face 382 includes a coupling block 383 formed thereon and having a pivot hole 384 adjacent pin hole 387.

According to the form shown, a cover 315 is mounted to base 811. Cover 315 includes a side opening 316 through which latch 38 is movable. Cover 315 further includes upper and lower openings 317. Base 811 is received in cover 315, with tab 889 of each third plate 883 abutting an inner face of cover 315. Screws are extended through cover 315 into tabs 889 of third plates 883 to fix cover 315 and base 811. First and second connecting rods 911 extend through upper and lower openings 317.

According to the form shown, a linking rod 730 is mounted between and spaced from first and second sidewalls 331 of bracket 33 along first axis X. Linking rod 730 has first and second ends 732 and 734 spaced from each other along second axis Y. Linking rod 730 further includes upper and lower faces 736 and 738 spaced from each other along first axis X.

First end 732 of linking rod 730 includes a slot 744 extending along second axis Y and having a front end 746 and a rear end 748 spaced from front end 746 along second axis Y and having a spacing to first end 732 of linking rod 730 larger than front end 746. Slot 744 extends from upper face 736 through lower face 738 of linking rod 730 and is aligned with slots 334 of brackets 33. First end 732 of linking rod 730 further includes a lateral face 740 extending between and perpendicular to upper and lower faces 736 and 738 of linking rod 730. Two lateral wings 751 are provided on upper and lower faces 736 and 738 and located at first end 732 of linking rod 730. Each lateral wing 751 includes a slot 753. A protrusion 742 protrudes from lateral face 740 along third axis Z and between upper and lower faces 736 and 738. Second end 734 of linking rod 730 includes an insertion block 752 formed on each of upper and lower faces 736 and 738. An engagement groove 755 is defined in the other lateral face 739 opposite to lateral face 740 of linking rod 730. Linking rod 730 further includes a limiting slot 750 between slot 744 and insertion block 752 and extending along second axis Y. Engagement groove 755 is located between lateral wings 751 and limiting slot 750 along second axis Y. Second end 734 of linking rod 730 further includes a hole 754 extending from upper face 736 through lower face 738.

According to the form shown, a limiting pin 44 is slideably extended through slots 334 of bracket 33 and slot 744 of linking rod 730. Linking rod 730 can move idly along second axis Y without actuating limiting pin 44. The idle travel of linking rod 730 is equal to a length of slot 744 along second axis Y. Specifically, when linking rod 730 is between first and second limit positions of its idle travel along second axis Y relative to limiting pin 44, limiting pin 44 received in slot 744 is not moved. However, when movement of linking rod 730 exceeds the first limit position (FIG. 3) or the second limit position (FIGS. 19 and 20), limiting pin 44 is moved along second axis Y together with linking rod 730.

According to the form shown, a pin 46 is extended through holes 339 of bracket 33 and limiting slot 750 to assist in stable movement of linking rod 730 along second axis Y between first and second sidewalls 331 of bracket 33. Two third axles 162 are provided, with one of third axles 162 slideably extended through second pivotal end 155 of first connecting arm 152 and slot 753 of one of lateral wings 751 of linking rod 730, with the other third axle 162 slideably extended through second pivotal end 155 of second connecting arm 152 and slot 753 of the other lateral wing 751 of linking rod 730. First and second connecting arms 152 pivot when linking rod 730 moves along second axis Y.

According to the form shown, door lock 3 further includes a yoke 757 fixed to linking rod 730 and having an end face 759. Yoke 757 is fixed in engagement groove 755 of linking rod 730. A spacing between a side of yoke 757 and each lateral wing 751 along third axis Z is slightly larger than a thickness of each of first and second connecting arms 152 along third axis Z, such that second pivotal end 155 of each of first and second connecting arms 152 is movable between yoke 757 and lateral wings 751. End face 759 of yoke 757 is located adjacent to or abuts protruded portion 879 of follower 875. When follower 875 pivots, protruded portion 879 presses against end face 759 of yoke 757, causing movement of linking rod 730 along second axis Y.

Figure 2:
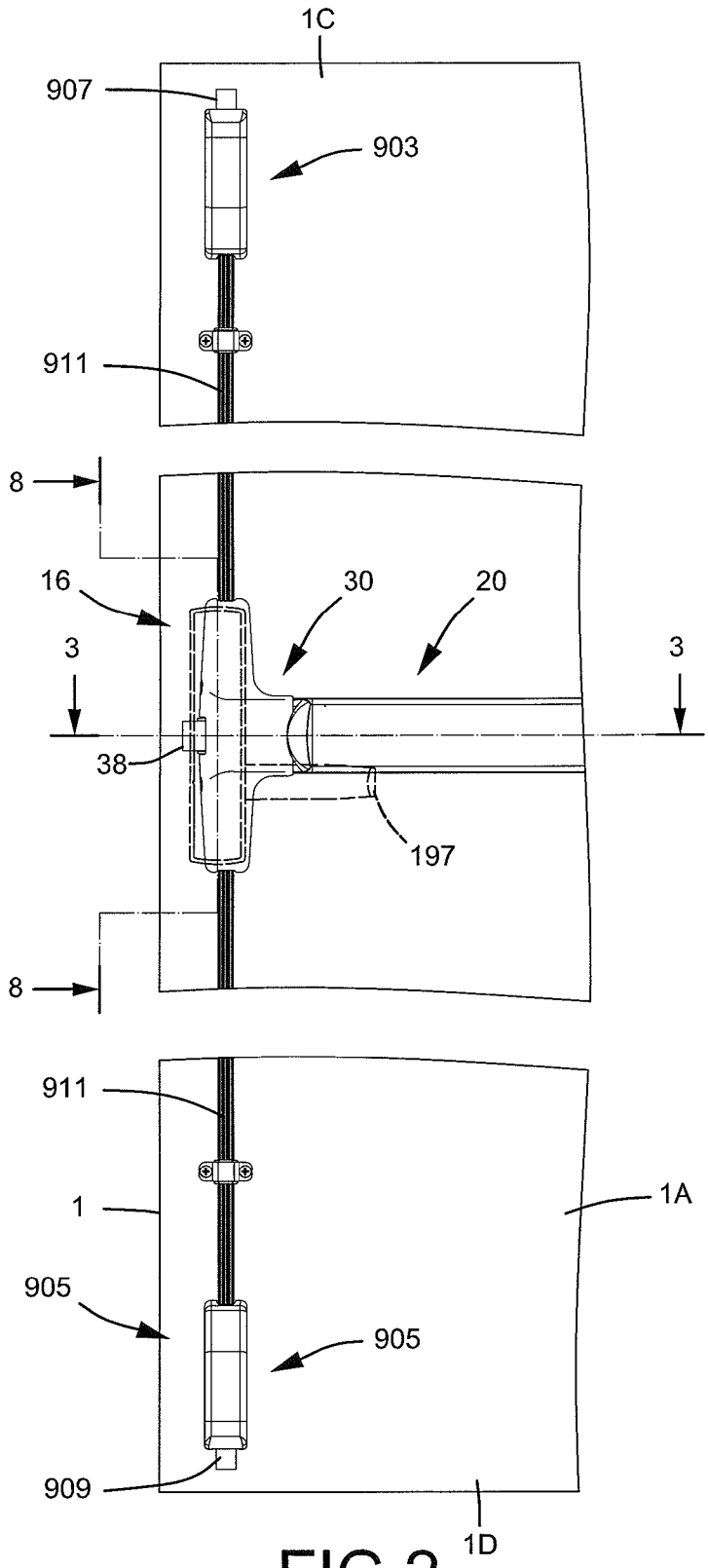
FIG. 2 shows a partial, side elevational view of the door lock of FIG. 1, with the door in an open position.
Figure 3:
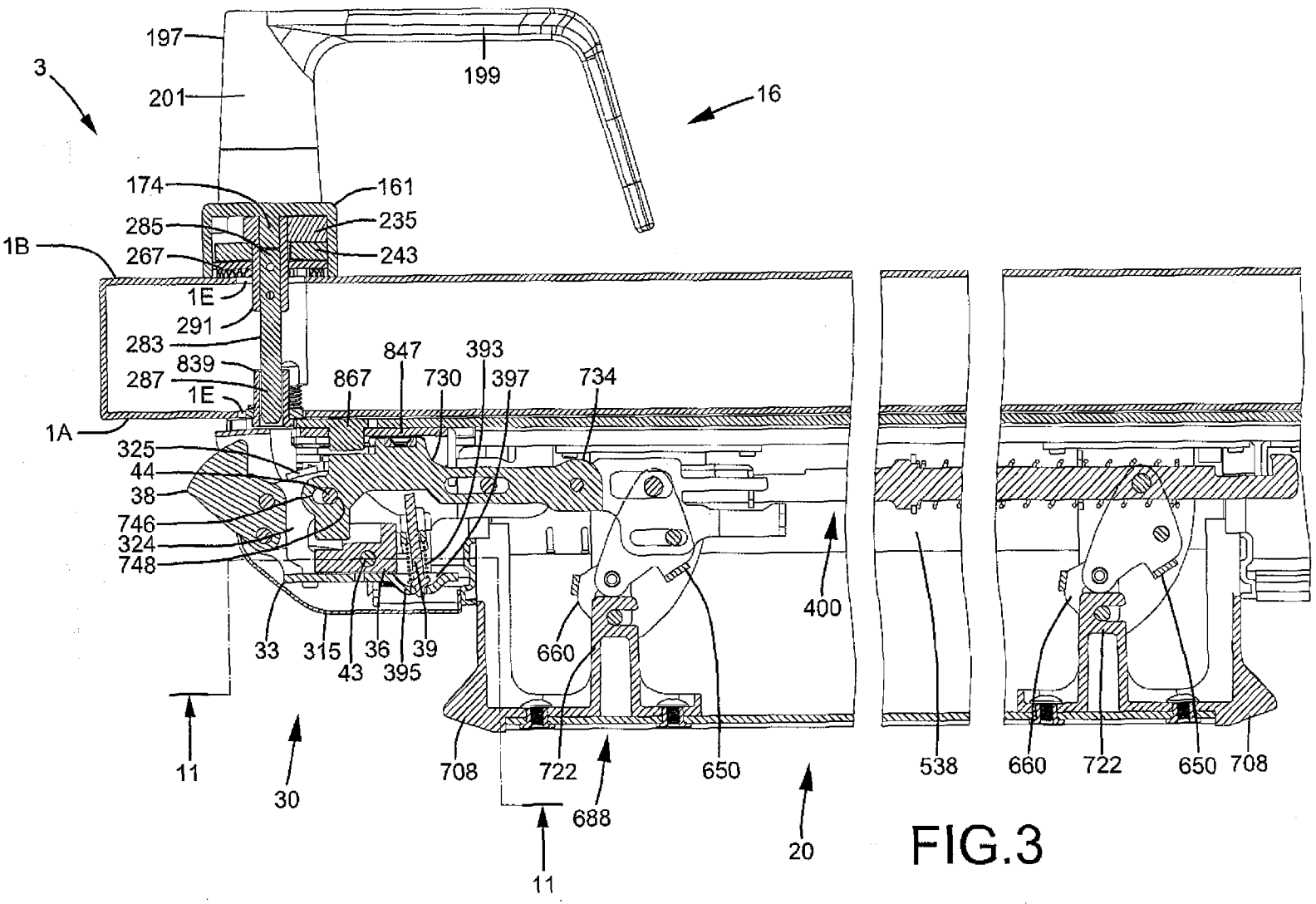
FIG. 3 shows a cross sectional view taken along section line 3-3 of FIG. 2 with a connecting rod in a first limit position.
Figure 4:
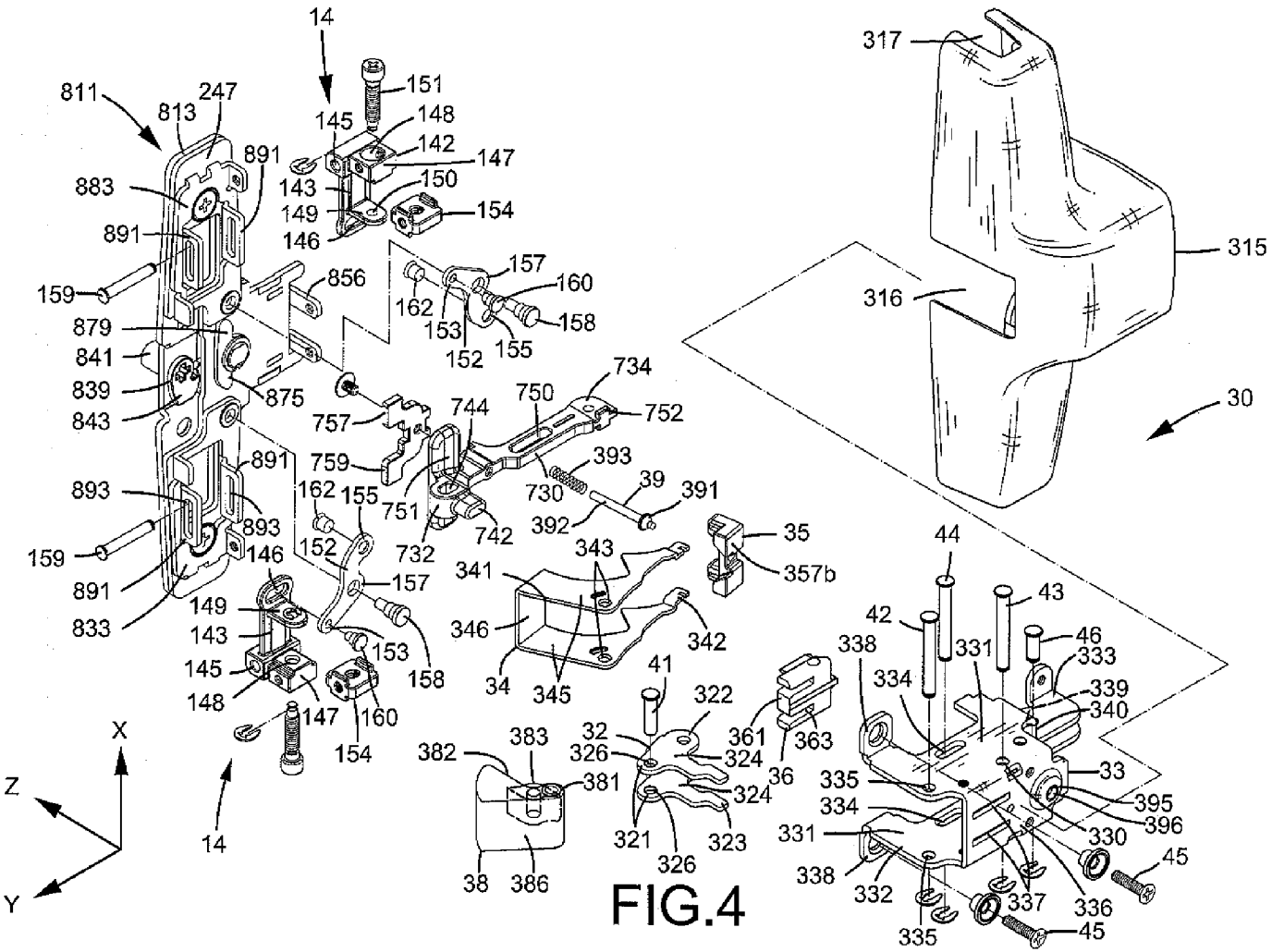
FIG. 4 shows an exploded, perspective view of a latch device of the door lock of FIG. 1.
Figure 5:
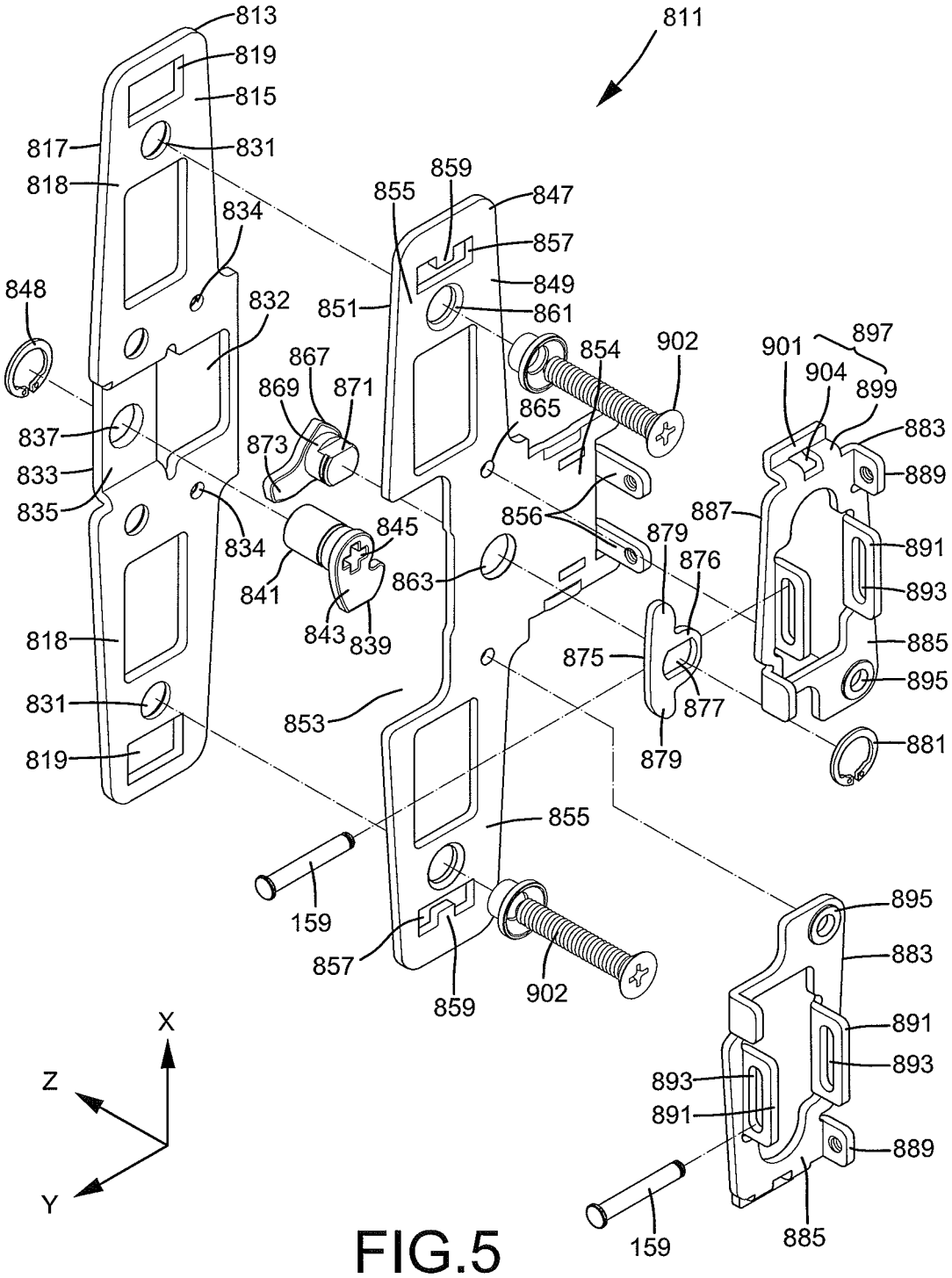
FIG. 5 shows an exploded, perspective view of a base of the latch device of FIG. 4.
Figure 20:
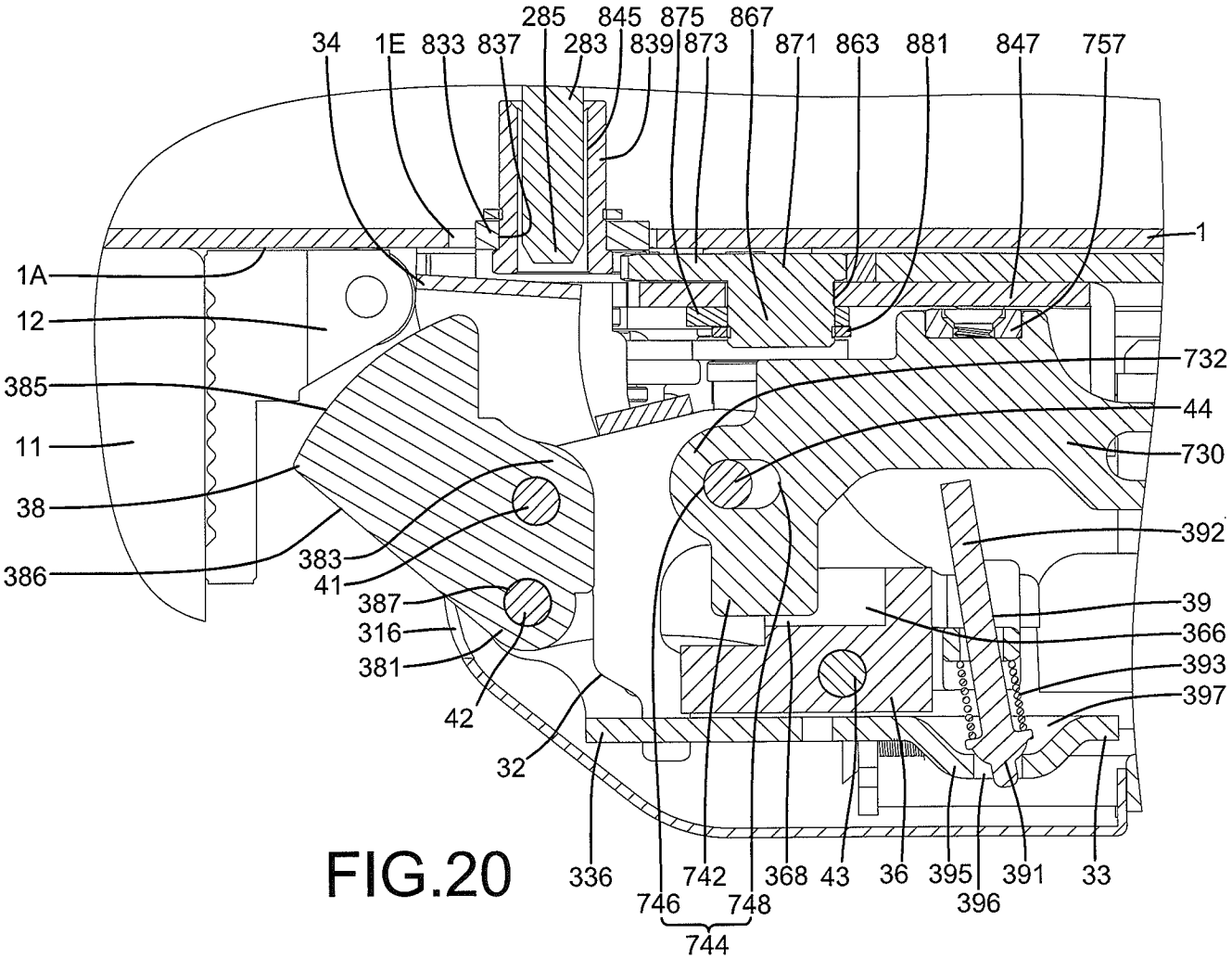
FIG. 20 shows a cross sectional view taken along section line 20-20 of FIG. 19.
Figure 21:
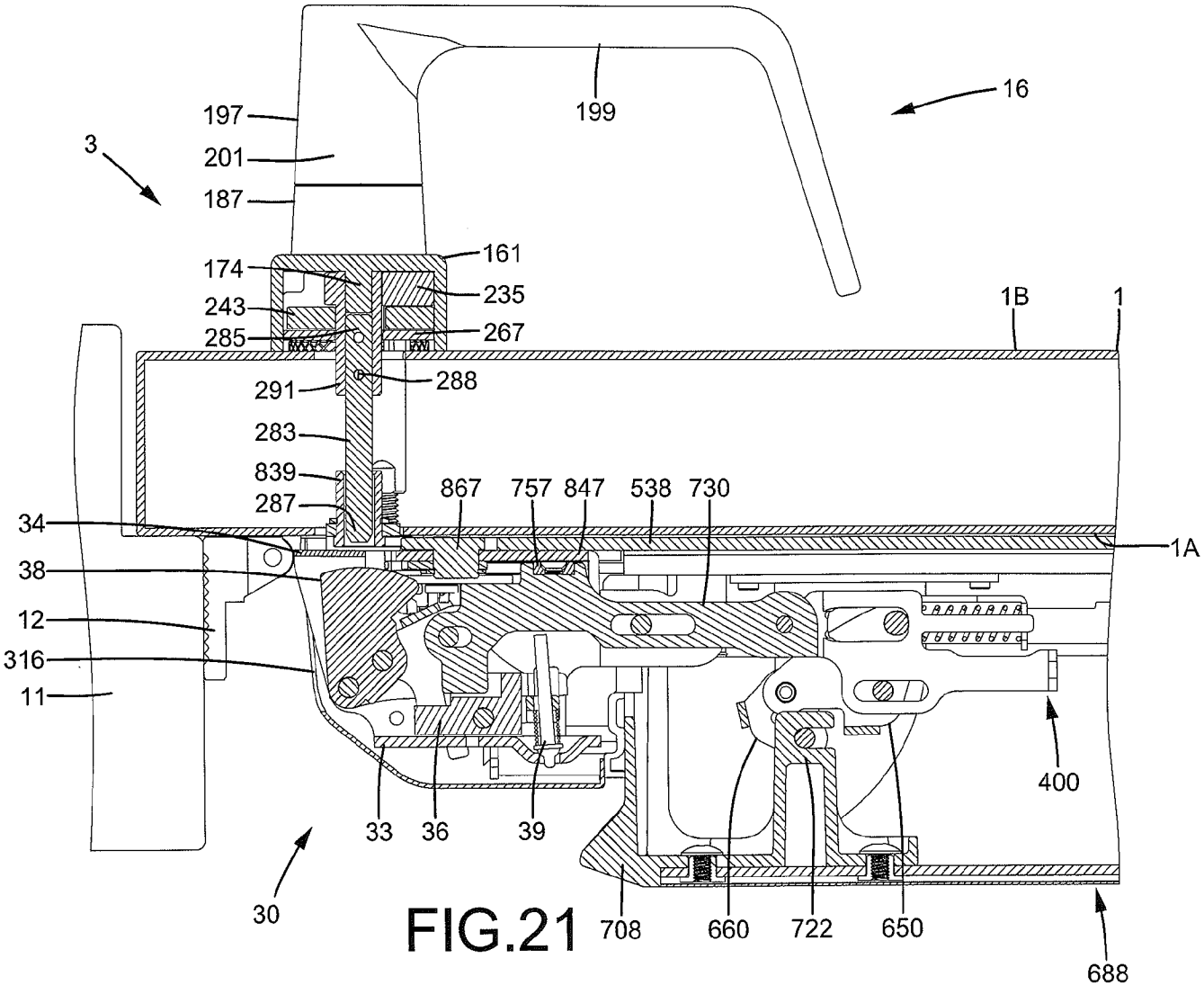
FIG. 21 shows a view similar to FIG. 16A, with a latch pivoted to a retracted, unlatching position.

According to the form shown, a follower 32 is pivotably connected to coupling block 383 of latch 38. Follower 32 is substantially U-shaped in cross section and includes parallel first and second side plates 324 spaced along first axis X and an interconnecting plate 325 interconnected between first and second side plates 324. Each of first and second side plates 324 includes first and second ends 321 and 322 spaced along second axis Y and an extension 323 extending from an intermediate portion thereof in a direction away from and perpendicular to interconnecting plate 325. First ends 321 of first and second side plates 324 include aligned pivot holes 326. A pivot 41 is extended through pivot hole 384 of coupling block 383 and pivot holes 326 of follower 32, allowing pivotal movement of follower 32 relative to latch 38 about a pivot axis defined by pivot 41 and parallel to and spaced from the pivot axis of latch pin 42. Extensions 323 of follower 32 are slideably extended through guide slots 337 of bracket 33. Second ends 322 of first and second side plates 324 include aligned pin holes 327 through which limiting pin 44 extends. When linking rod 730 is in the first limit position of its idle travel, limiting pin 44 is in rear end 748 of slot 744 (FIG. 3). On the other hand, when linking rod 730 is in the second limit position of its idle travel, limiting pin 44 is in front end 746 of slot 744 (FIG. 20). Specifically, limiting pin 44 received in slot 744 is not moved when linking rod 730 is moved from the first limit position to the second limit position in an unlatching direction along second axis Y or moved from the second limit position to the first limit position in a latching direction opposite to the unlatching direction. However, when linking rod 730 in the second limit position (FIG. 20) is further moved leftward (as viewed from FIG. 20) in the unlatching direction away from latch 38 along second axis Y, limiting pin 44 is moved leftward along second axis Y and pivots latch 38 from the latching position (FIGS. 2 and 3) to the retracted, unlatching position (FIG. 21).

Figure 6:
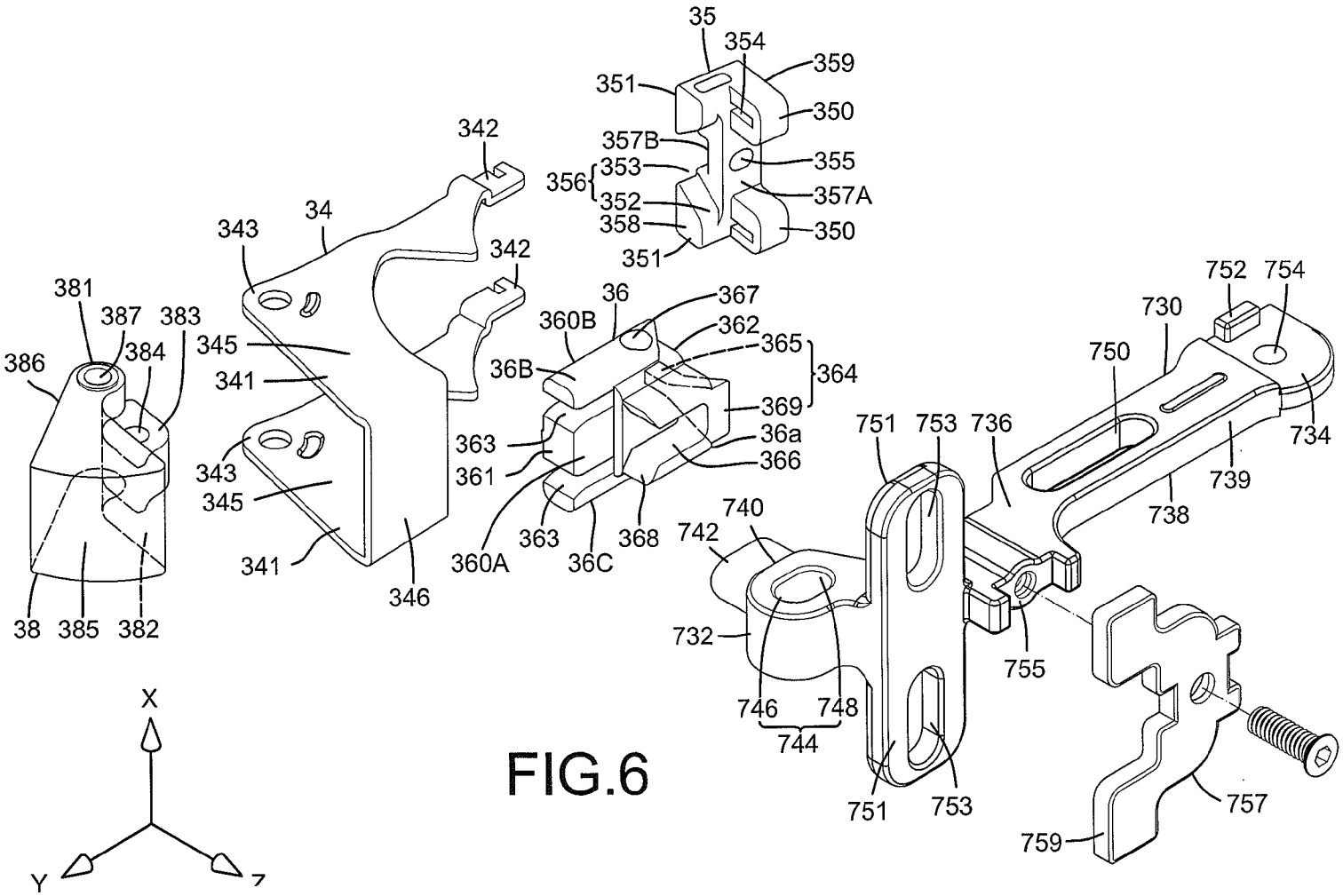
FIG. 6 shows an enlarged, exploded, perspective view of some components of the latch device of FIG. 4.
Figure 7:
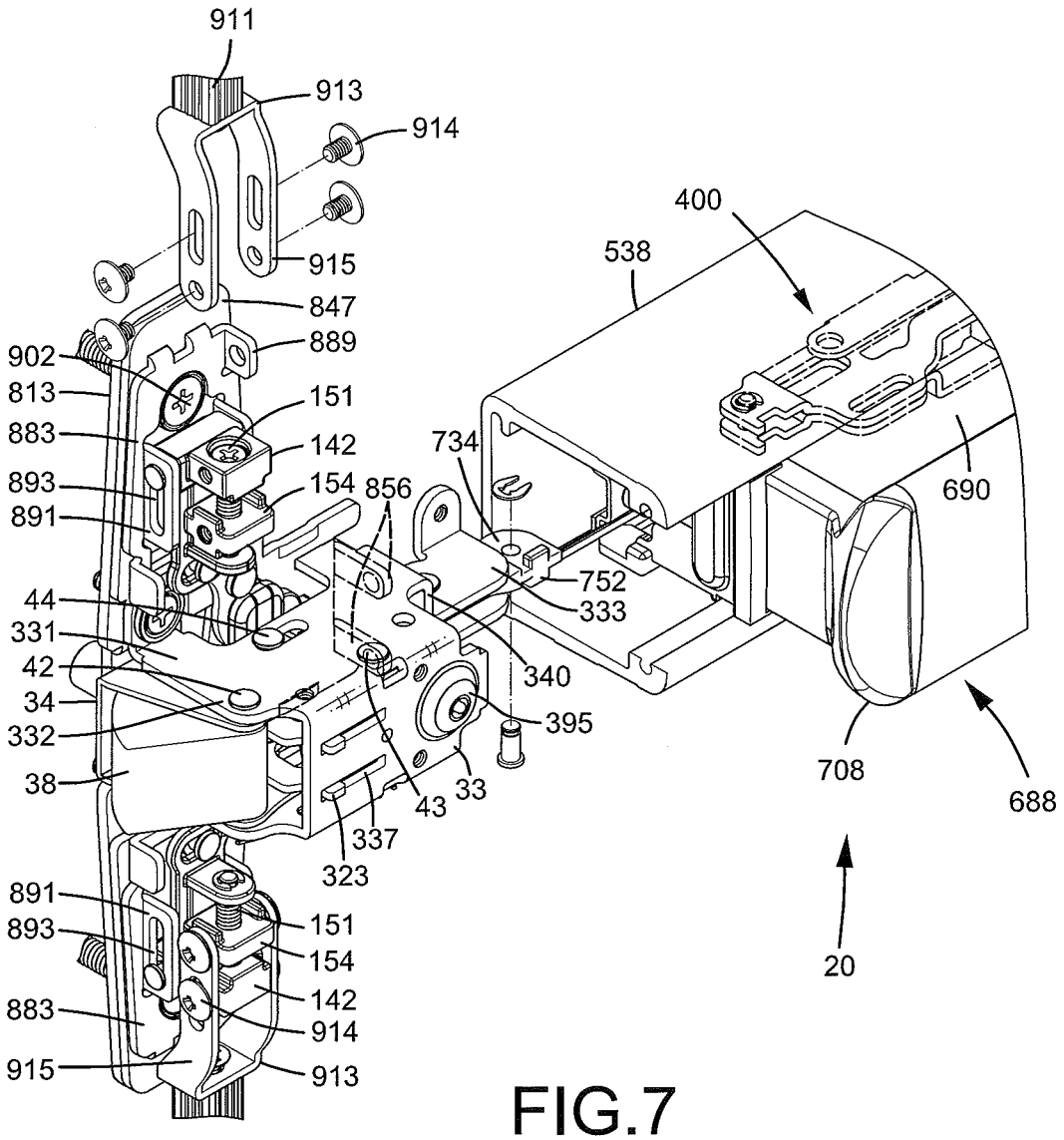
FIG. 7 shows an exploded, perspective view of the latch device and an inner operational device of the door lock of FIG. 1.
Figure 11:
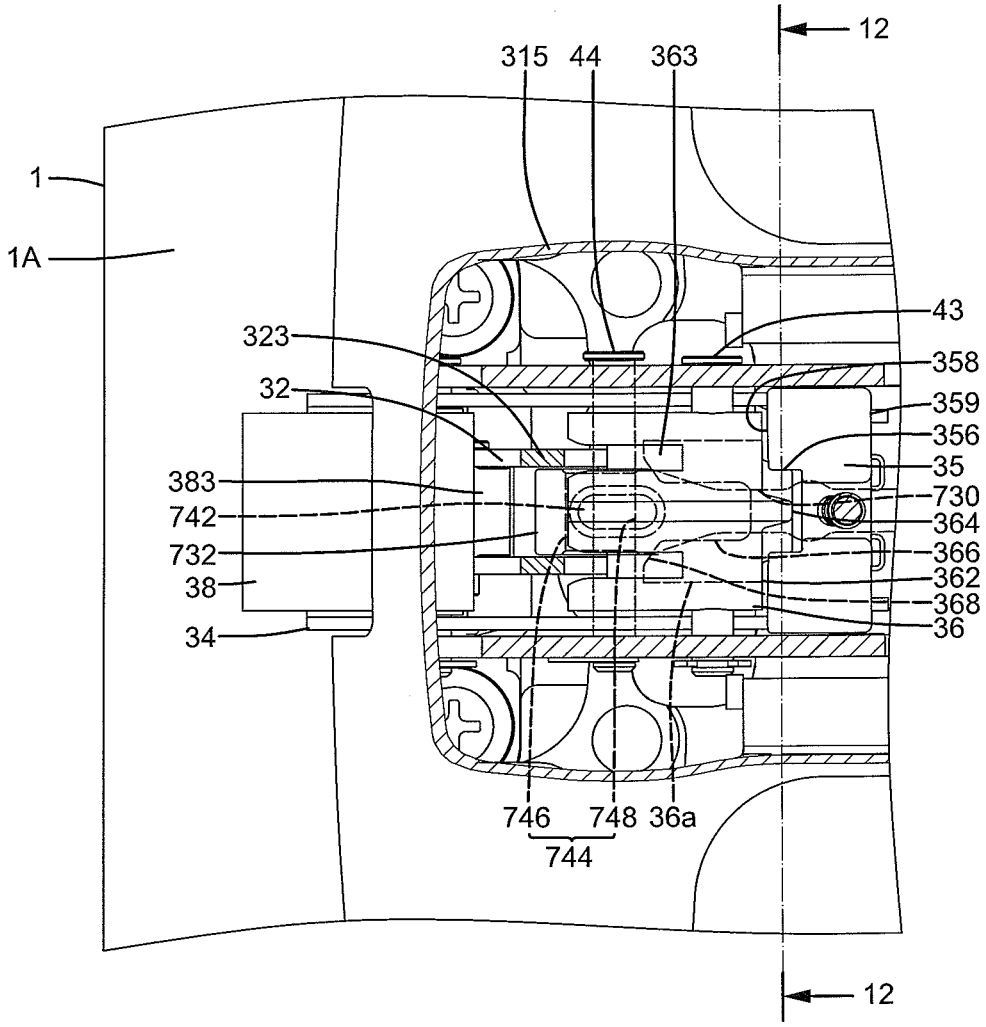
FIG. 11 shows a cross sectional view taken along section line 11-11 of FIG. 3.

According to the form shown, a locking member 36 is mounted between first and second sidewalls 331 of bracket 33 and spaced from first end 732 of linking rod 730. Locking member 36 is substantially E-shaped in cross section (FIGS. 6 and 11). Specifically, locking member 36 includes front and rear faces 361 and 362 spaced along second axis Y. Locking member 36 further includes first and second lateral faces 360A and 360B extending perpendicularly to and between front and rear faces 361 and 362. First lateral face 360A faces linking rod 730 and includes a lump 36A formed on a rear portion thereof distant to front face 361. Lump 36A includes a groove 366 facing protrusion 742 of linking rod 730 and having an end opening 368. End opening 368 has a spacing to front face 361 along second axis Y smaller than groove 366. Furthermore, end opening 368 has increasing widths along first axis X away from rear face 362 of locking member 36. Locking member 36 further includes top and bottom faces 36B and 36C spaced along first axis X and extending perpendicularly to and between front and rear faces 361 and 362 and extending perpendicularly to and between first and second lateral faces 360A and 360B. A vertical hole 367 extends from top face 36B through bottom face 36C of locking member 36. Two guide grooves 363 extend from front face 361 towards but spaced from rear face 362 along second axis Y. Guide grooves 363 are spaced along first axis X and spaced from top and bottom faces 36B and 36C of locking member 36. Furthermore, guide grooves 363 are spaced from groove 366 along third axis Z. A guide piece 364 in the form shown as a lug is formed on rear face 362 of locking member 36 and integrally formed with lump 36A as a single continuous monolithic member. Guide piece 364 includes a narrower section 365 and a wider section 369. Wider section 369 has a spacing to second lateral face 360B along third axis Z larger than narrower section 365 and has a width along first axis X larger than that of narrower section 365. Wider section 369 includes triangular cross sections (when viewing rear face 362 along second axis Y) and has decreasing widths toward narrower section 365 along third axis Z.

Figure 12:
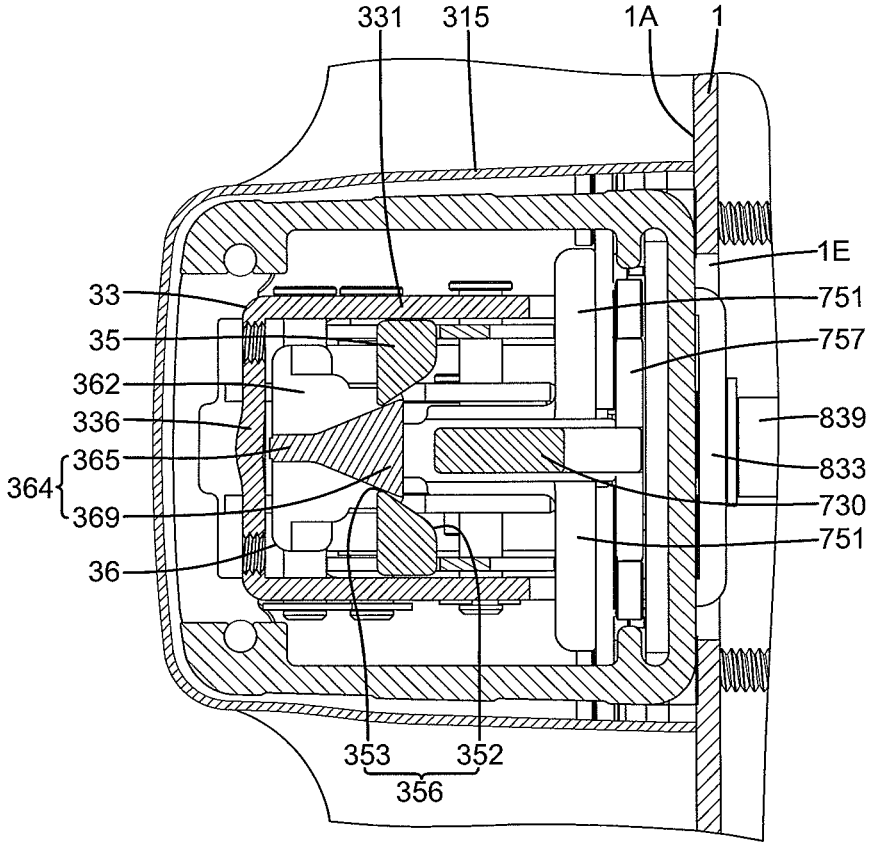
FIG. 12 shows a cross sectional view taken along section line 12-12 of FIG. 11.

A guide pin 43 is extended through pin holes 330 of bracket 33 and vertical hole 367 of locking member 36, allowing movement of locking member 36 between an upper, unlocking position (FIGS. 11 and 12) and a lower, locking position (FIGS. 17 and 18) spaced from the upper, unlocking position along first axis X.

Figure 17:
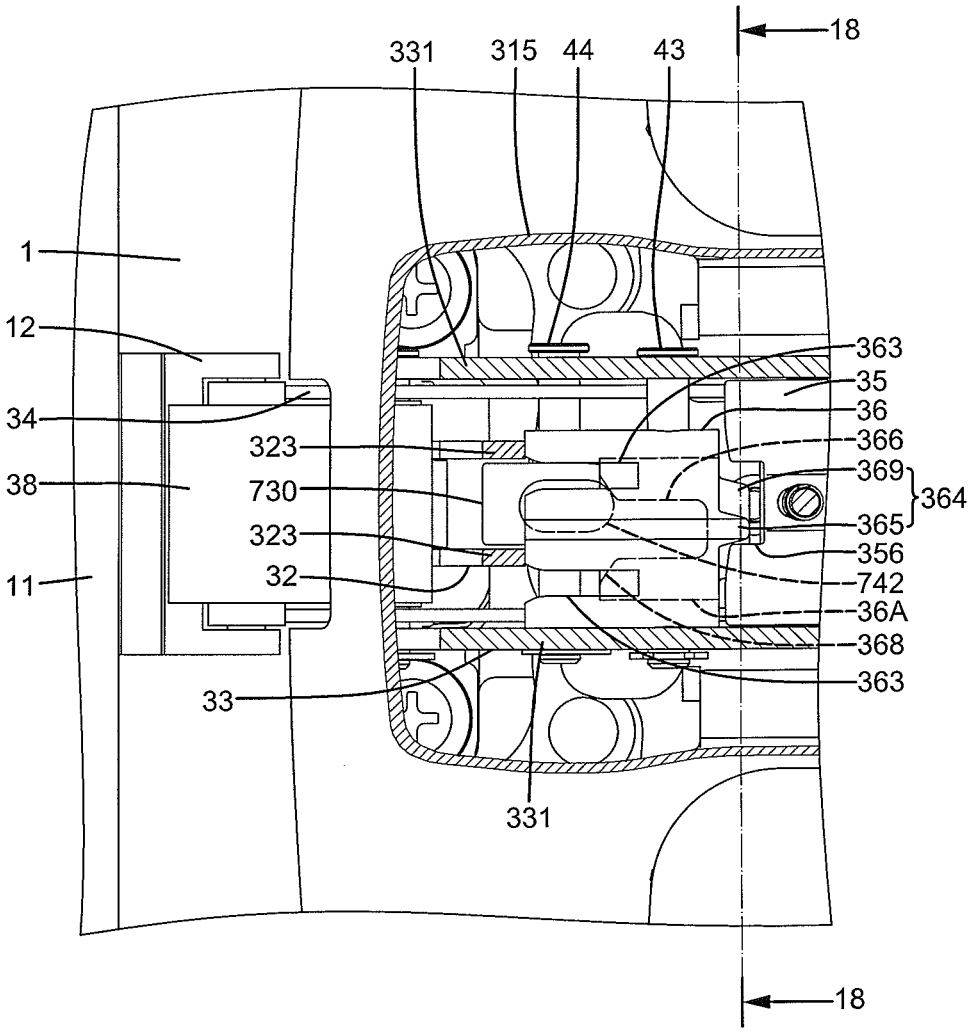
FIG. 17 shows a cross sectional view taken along section line 17-17 of FIG. 16A.

According to the form shown, a substantially U-shaped swaying plate 34 is pivotably mounted in bracket 33. Swaying plate 34 includes parallel first and second side boards 345 spaced along first axis X and received between sidewalls 331 of bracket 33. Swaying plate 34 further includes an interconnecting board 346 interconnected between first and second side boards 345. Each of first and second side boards 345 is substantially L-shaped and includes a first end 341 interconnected to interconnecting board 346, a second end 342, and a pivotal portion 343 on an intermediate portion intermediate the first and second ends 341 and 342. Second ends 342 of first and second side boards 345 are received between first and second sidewalls 331 of bracket 33. First ends 341 of first and second side boards 345 of swaying plate 34 are movable through side opening 316 between a first, outer position outside of cover 315 (FIGS. 3 and 9) and a second, inner position partially received in cover 315 (FIGS. 16 and 17). Latch pin 42 is extended through aligned pin holes in pivotal portions 343 of swaying plate 34 to allow pivotal movement of swaying plate 34 about the pivot axis defined by latch pin 42. Each of first and second side boards 345 includes a drive piece formed on the intermediate portion thereof and adjacent to first end 341 thereof. The drive pieces extend toward each other along first axis X.

According to the form shown, a limiting block 35 is mounted to swaying plate 34 to move therewith. Limiting block 35 is movable between a holding position (FIGS. 3 and 12) corresponding to the first, outer position (FIGS. 3 and 9) of first ends 341 of first and second side boards 345 of swaying plate 34 and a releasing position (FIGS. 18 and 20) corresponding to the second, inner position (FIGS. 16 and 17) of first ends 341 of first and second side boards 345 of swaying plate 34. Limiting block 35 includes first and second lateral faces 357A and 357B spaced along third axis Z. Limiting block 35 further includes front and rear faces 358 and 359 spaced along second axis Y and extending perpendicularly to and between first and second lateral faces 357A and 357B. Upper and lower ears 350 are formed on upper and lower ends of first lateral face 357A and spaced from each other along first axis X. Each of upper and lower ears 350 has an engaging groove 354 formed in a front face thereof. Second ends 342 of first and second side boards 345 of swaying plate 34 are coupled with engaging grooves 354 to allow joint pivotal movement of swaying plate 34 and limiting block 35. A through-hole 355 extends from first lateral face 357A through second lateral face 357B along third axis Z and is intermediate upper and lower ears 350. A guide groove 356 is formed in an intermediate portion of front face 358 of limiting block 35 and extends from first lateral face 357A through second lateral face 357B along third axis Z, leaving upper and lower protrusions 351 on upper and lower ends of front face 358. Guide groove 356 is substantially trapezoidal in cross section and includes a first, larger end 352 in first lateral face 357A and a second, smaller end 353 in second lateral face 357B. Second, smaller end 353 is spaced from first, larger end 352 along third axis Z. Second, smaller end 353 has a width along first axis X smaller than a width of the first, larger end 352 along first axis X. Specifically, guide groove 356 has decreasing widths from first, larger end 352 toward second, smaller end 353. Second, smaller end 353 of guide groove 356 has a minimum width along first axis X smaller than a maximum width of wider section 369 of guide piece 364 of locking member 36 along first axis X.

According to the form shown, a guide rod 39 is mounted between limiting block 35 and interconnecting wall 336 of bracket 33. Specifically, guide rod 39 includes a head 391 and a shank 392 extending from a side of head 391 and having an end slideably received in through-hole 355 of limiting block 35. The other side of head 391 is domed and includes a tip extending through hole 396 of bulged section 395 to prevent head 391 from disengaging from interconnecting wall 336. An outer periphery of the domed side of the head 391 slideably abuts an inner periphery of hole 396 of bulged section 395 so that head 391 can swivel against the inner periphery of hole 396 when shank 392 moves together with limiting block 35. A spring 393 is mounted around shank 392 between the side of head 391 and second lateral face 357B of limiting block 35. Note that a portion of head 391 outside of hole 396 is received in cavity 397 to avoid interference in operation of guide rod 39 and other components.

According to the form shown, inner operational device 20 is coupled with second end 734 of linking rod 730. Inner operational device 20 includes a substantially U-shaped casing 538 fixed to first side 1A of door 1 and located adjacent to base 811. Casing 538 receives a pull mechanism 400 connected to insertion block 752 of second end 734 of linking rod 730.

Inner operational device 20 further includes first and second traction members 650 pivotably connected to pull mechanism 400 (FIG. 3) and first and second follower elements 660 respectively and pivotably connected to first and second traction members 650. Inner operational device 20 further includes first and second end caps 708, with each of first and second end caps 708 having a hook 722 pivotably mounted to each of first and second follower elements 660. When an operative member 688 is moved by an external force along third axis X and causes pivotal movement of first and second follower elements 660, first and second traction members 650 pivot to move pull mechanism 400 along second axis Y, causing linking rod 730 to move along second axis Y.

Figure 13:
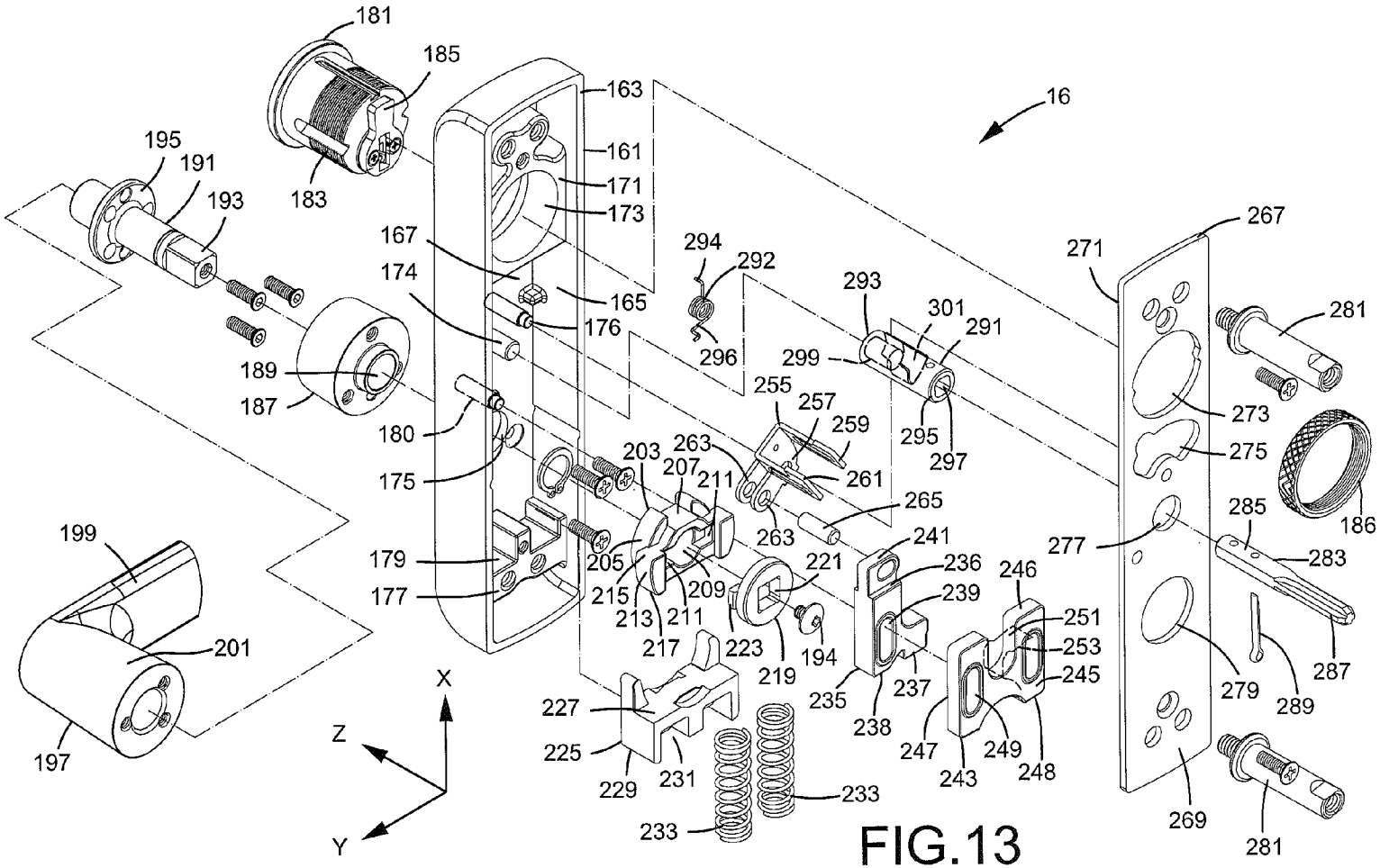
FIG. 13 shows an exploded, perspective view of an outer operational device of the door lock of FIG. 1.

According to the form shown, outer operational device 16 includes a housing 161 mounted to second side 1B of door 1 (FIGS. 3 and 13). Housing 161 includes an end face 163 in which a space 15 is defined. Space 165 includes a bottom wall 167 spaced from end face 163 along third axis Z. A receiving portion 171 is formed on bottom wall 167 and received in space 165. A receiving hole 173 is defined in receiving portion 171 and is in communication with space 165 and the outside. First and second pegs 174 and 176 and a limiting peg 180 are formed on bottom wall 167. An engagement hole 175 is defined in bottom wall 167, with first peg 174 located between second peg 176 and engagement hole 175 along first axis X. An engagement portion 177 is formed on bottom wall 167 and includes two recesses 179, with engagement hole 175 located between limiting peg 180 and engagement portion 177 along first axis X.

Outer operational device 16 further includes a sleeve 187 fixed to an outer side of bottom wall 167 and having a pivot hole 189 aligned with engagement hole 175 of housing 161. A spindle 191 is mounted to housing 161 and includes a flange 195 on an intermediate portion thereof. Spindle 191 further includes an engagement end 193 having non-circular cross sections. Spindle 191 is pivotably received in pivot hole 189 of housing 161, with flange 195 abutting an end face of sleeve 187, with engagement end 193 located outside of sleeve 187 and received in space 165 of housing 161.

Figure 24:
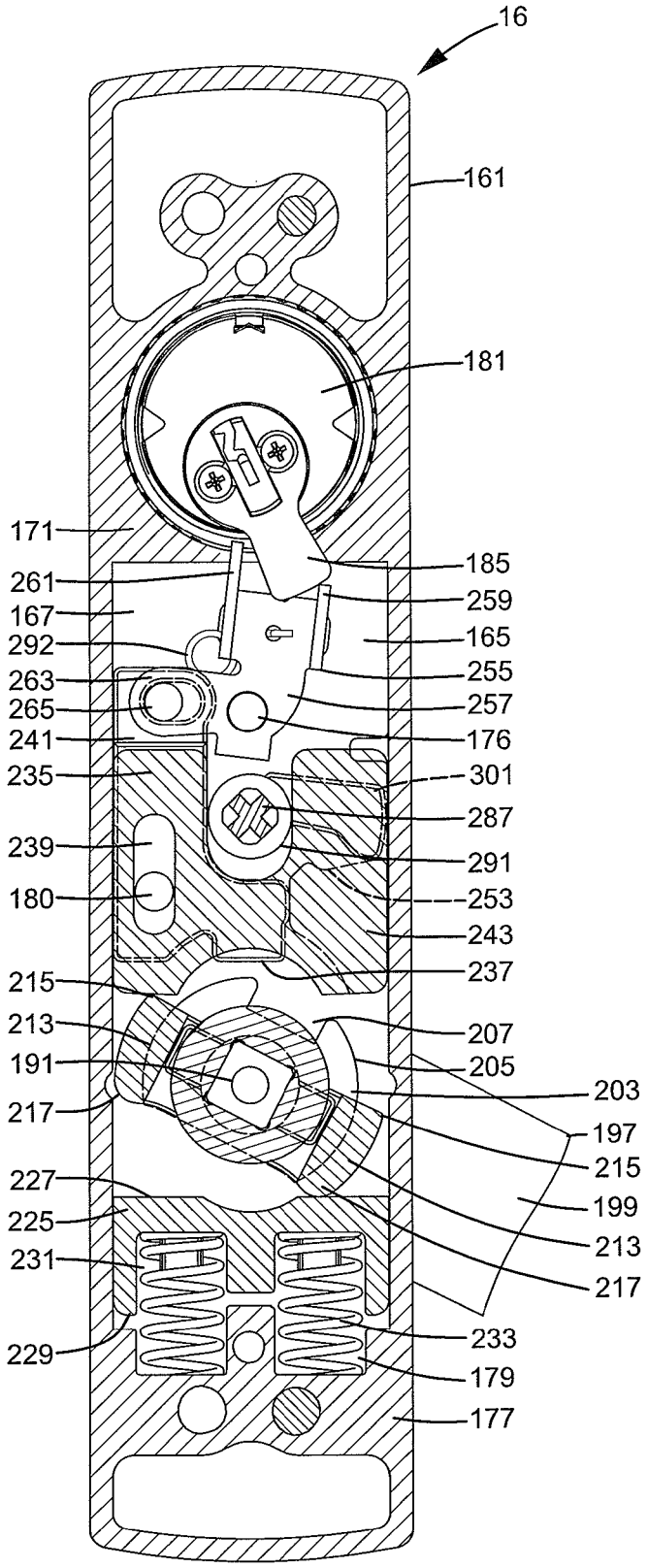
FIG. 24 shows a view similar to FIG. 14, with a handle rotated.
Figure 26:
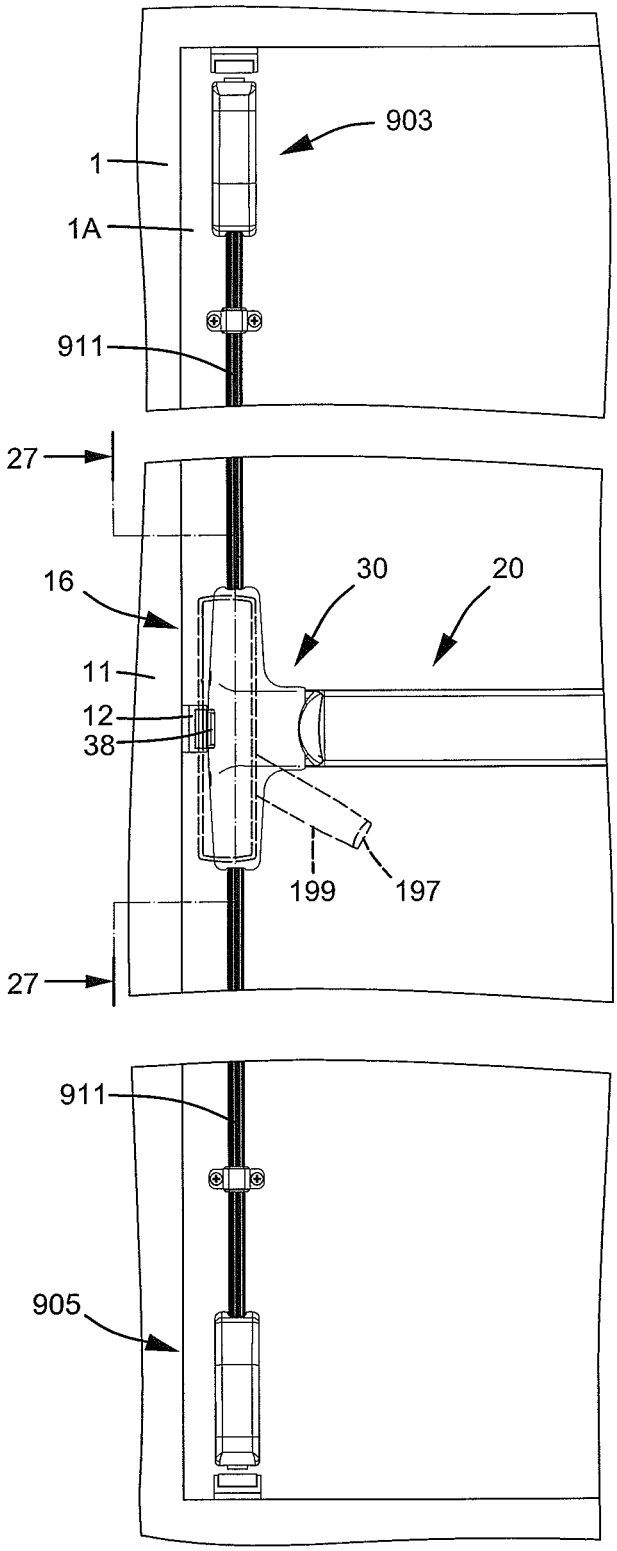
FIG. 26 shows a view similar to FIG. 16, with the handle rotated.

Outer operational device 16 further includes a handle 197 having an engagement portion 201 and a handgrip 199 fixed to engagement portion 201. Handle 197 and spindle 191 are jointly pivotable about a pivot axis defined by spindle 191 between a first position (FIG. 2) and a second position (FIGS. 24 and 26).

Outer operational device 16 further includes a push block 203 mounted to and jointly pivotable with spindle 191. Push block 203 includes a peripheral wall 205 having a positioning groove 207. Two push portions 213 are formed on peripheral wall 205, with positioning groove 207 located between push portions 213 in a circumferential direction about the pivot axis of spindle 191 extending along third axis Z. Each push portion 213 has upper and lower ends 215 and 217 spaced from each other along first axis X. A connection hole 209 extends from a side through the other side of push block 203 along third axis Z and includes an inner periphery having two insertion grooves 211. Engagement end 193 of spindle 191 is received in connection hole 209 of push block 203.

Outer operational device 16 further includes an actuator 219 mounted around spindle 191 to pivot together with spindle 191. An actuation hole 221 extends from a side through the other side of actuator 219 along third axis Z. Two teeth 223 are formed on the other side of actuator 219 and engaged in insertion grooves 211 of push block 203. Engagement end 193 of spindle 191 is engaged in actuation hole 221 of actuator 219, with an end face of engagement end 193 substantially flush with the side of actuator 219. A screw 194 is extended through spindle 191 and abuts the side of the actuator 219, preventing actuator 219 and push block 203 from disengaging from spindle 191 along third axis Z. Rotation of spindle 191 resulting from rotation of handle 197 causes rotation of actuator 219 and push block 203 about the pivot axis of spindle 191, as each tooth 223 presses against a wall of one of insertion grooves 211 of push block 203.

Figure 28:
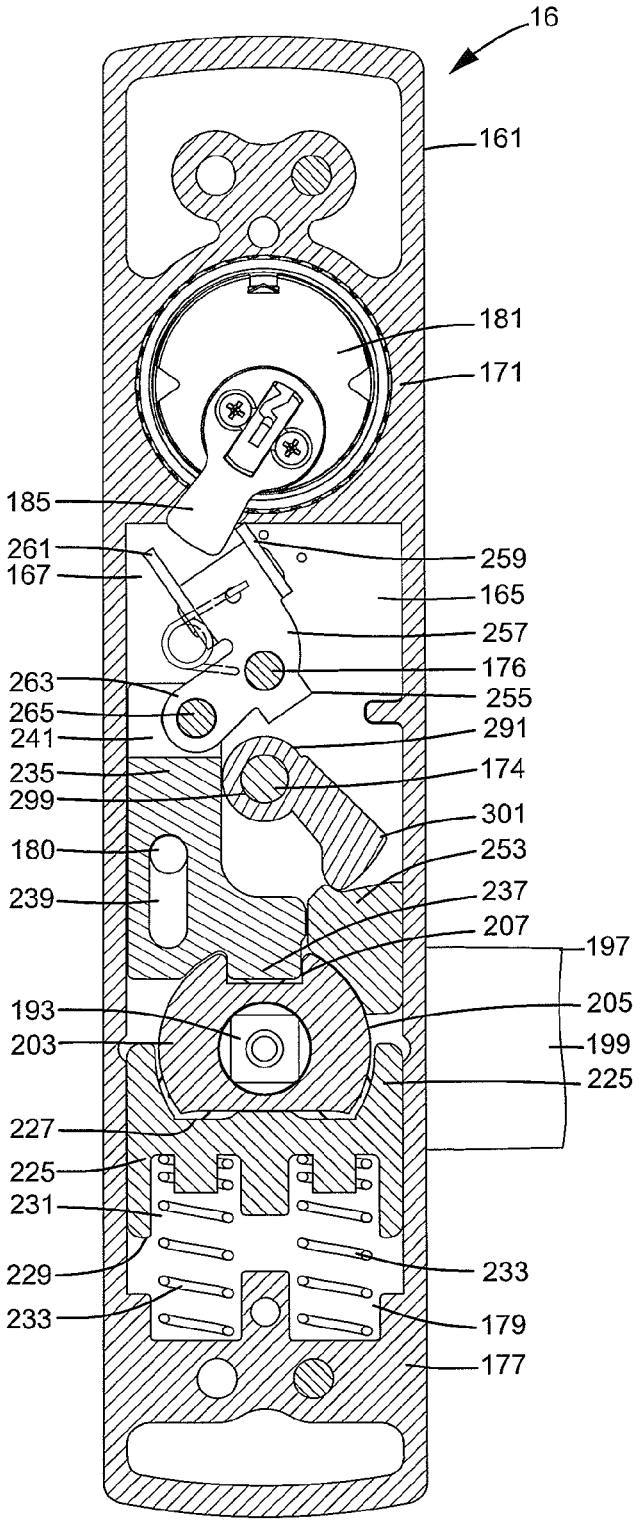
FIG. 28 shows a view similar to FIG. 15, with an actuating plate of a cylinder pivoted, with a positioning block moved to a lower position.

Outer operational device 16 further includes a positioning block 235 received in space 165 of housing 161 and movable along first axis X. Positioning block 235 includes upper and lower ends 236 and 238 spaced from each other along first axis X, with upper end 236 having a coupling portion 241, with lower end 238 having a positioning portion 237. An elongated slot 239 extends from a side through the other side of positioning block 235 along third axis Z. Positioning block 235 is located above push block 203 along first axis X, with limiting peg 180 of housing 161 extending through elongated slot 239. Thus, positioning block 235 is slideable in a length of elongated slot 239 along first axis X between an upper position (FIG. 15) and a lower position (FIG. 28). When handle 197 is in the first position, positioning portion 237 of positioning block 235 is aligned with positioning groove 207 of push block 203 along the first axis X.

Figure 14:
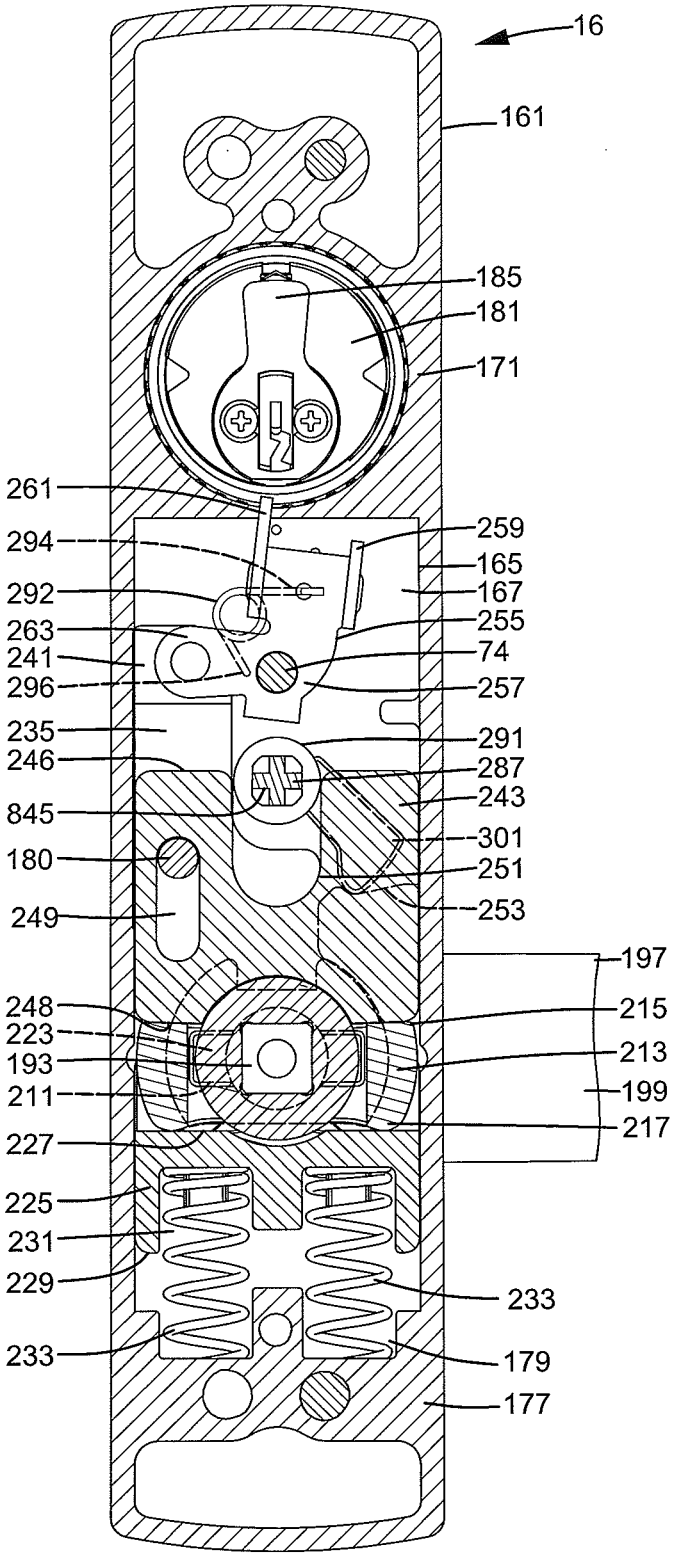
FIG. 14 shows a cross sectional view taken along section line 14-14 of FIG. 8.

Outer operational device 16 further includes an actuating member 255 pivotably received in space 165 of housing 161. Actuating member 255 includes a pivotal portion 257 pivotably connected to second peg 176 of housing 161 and two engagement plates 263 pivotably engaged with coupling portion 241 of positioning block 235. Actuating member 255 further includes first and second stops 259 and 261 formed on two sides of pivotal portion 257. An actuating pin 265 extends through each engagement plate 263 of actuating member 255 and coupling portion 241 of positioning block 235. A spring 292 has a first tang 294 fixed to bottom wall 167 of housing 161 and a second tang 296 fixed to actuating member 255 (FIG. 14). When actuating member 255 pivots about a pivot axis defined by second peg 176, each engagement plate 263 of actuating member 255 drives actuating pin 265 and, thus, moves positioning block 235 between the upper and lower positions. Spring 292 biases actuating member 255, maintaining positioning block 235 in one of the upper and lower positions.

Outer operational device 16 further includes a movable block 243 slideably received in housing 161. Movable block 243 includes first and second surfaces 245 and 247 spaced from each other along third axis Z. Movable block 243 further includes upper and lower surfaces 246 and 248 extending between first and second surfaces 245 and 247. A groove 251 is defined in upper surface 246. A protrusion 253 is formed on second surface 247 of movable block 243 and located adjacent to lower surface 248. A longitudinal groove 249 extends from first surface 245 through second surface 247 of movable block 243 along third axis Z. Groove 251 is located between longitudinal groove 249 and protrusion 253. Second surface 247 of movable block 243 abuts a face of positioning block 235, such that positioning block 235 is located between bottom wall 167 of housing 161 and movable block 243. Protrusion 253 of movable block 243 is spaced from positioning block 235 along second axis Y. Movable block 243 is movable along first axis X between a releasing position (FIG. 14) and a pressing position (FIG. 24). When movable block 243 is in the releasing position, lower surface 248 of movable block 243 abuts upper end 215 of each push portion 213 of push block 203. Thus, when push block 203 pivots, upper end 215 of one of push portions 213 pushes movable block 243 to move along first axis X.

Outer operational device 16 further includes a sleeve 291 pivotably connected to housing 161. Sleeve 291 includes first and second ends 293 and 295, with first end 293 including a pivot hole 299, with second end 295 including a connection hole 297 with non-circular cross sections. An arm 301 is formed on an outer periphery of sleeve 291 and located at first end 293 of sleeve 291. First peg 174 of housing 161 is received in pivot hole 299 of sleeve 291. A distal end of arm 301 abuts an upper face of protrusion 253 of movable block 243. Sleeve 291 is aligned with groove 251 of movable block 243 along first axis X. When movable block 243 moves from the releasing position to the pressing position, protrusion 253 of movable block 243 presses against arm 301 of sleeve 291, causing pivotal movement of sleeve 291 about a pivot axis defined by first peg 174. Groove 251 of movable block 243 provides a room for sleeve 291, allowing movable block 243 to smoothly move from the releasing position to the pressing position.

Outer operational device 16 further includes a follower rod 283 coupled to sleeve 191. Follower rod 283 includes a connection section 285 and a follower section 287. Connection section 285 is coupled in connection hole 297 of sleeve 291, allowing joint pivotal movement of sleeve 291 and follower rod 283 about the pivot axis defined by first peg 174. A pin 289 extends through second end 295 of sleeve 291 and connection section 285 of follower rod 283, preventing follower rod 283 from disengaging from sleeve 291. Follower section 287 of follower rod 283 is extend through through-hole 1E of door 1 into connection hole 845 of connection member 839 of latch device 30, allowing joint pivotal movement of follower rod 283 and connection member 839. Thus, when sleeve 291 causes pivotal movement of follower rod 283, connection member 839 also pivots.

Outer operational device 16 further includes a cylinder 181 having a lock core rotatable by a key. An actuating plate 185 is provided on a rear end of cylinder 181 and jointly rotatable with the lock core. A threaded portion 183 is formed on an outer periphery of the rear end of cylinder 181. Cylinder 181 is received in receiving hole 173 of receiving portion 171, with actuating plate 185 located in space 165 of housing 161.

When actuating plate 185 pivots, one of first and second stops 259 and 261 of actuating member 255 is pressed against by actuating plate 185 to cause pivotal movement of actuating member 255.

Outer operational device 16 further includes a pressing block 225 received in space 165 of housing 161 and located between engagement portion 177 and push block 203 along first axis X. Pressing block 225 includes upper and lower faces 227 and 229 spaced from each other along first axis X. Pressing block 225 further includes two compartments 231 defined in lower face 229. A spring 233 is received in each compartment 231 of pressing block 225 and one of recesses 179 of engagement portion 177 of housing 161. Springs 233 bias pressing block 225, causing upper face 227 of pressing block 225 to press against lower ends 217 of push portions 213 of push block 203.

Outer operational device 16 further includes a lid 267, two mounting posts 281, and a locking ring 186. Lid 267 includes an outer surface 269 and an inner surface 271 spaced from outer surface 269 along third axis Z. Lid 267 further includes first, second, third, and fourth holes 273, 275, 277, and 279, with each of first, second, third, and fourth holes 273, 275, 277, and 279 extending from outer surface 269 through inner surface 271. Lid 267 is received in space 165 of housing 161, with inner surface 271 of lid 267 abutting receiving portion 171 and engagement portion 177. Threaded portion 183 of cylinder 181 extends through first hole 273 of lid 267 to an outer side of lid 267. First and second stops 259 and 261 of actuating member 255 extends through second hole 275 of lid 267 to the outer side of lid 267. Second end 295 of sleeve 291 and follower rod 283 extends through third hole 277 of lid 267 to the outer side of lid 267. Fourth hole 279 of lid 267 receives actuator 219 and screw 194.

Mounting posts 281 of outer operational device 16 extend through second side 1B of door 1 and are aligned with through-holes 831 of latch device 30 (FIG. 8). Screws 902 are extended through through-hole 861 of second plate 847 and through-holes 831 of first plate 813 into mounting posts 281. Thus, door 1 is sandwiched between latch device 30 and inner and outer operational devices 20 and 16.

Now that the basic construction of door lock 3 of the present invention has been explained, the operation and some of the advantages of door lock 3 can be set forth and appreciated. In particular, for the sake of explanation, it will be assumed that door 1 is open (FIG. 3) and latch 38 is in its extended, latching position and can be moved to its retracted, unlatching position. First ends 341 of first and second side boards 345 of swaying plate 34 are in the first, outer position outside of cover 315 under the action of spring 393 that presses against limiting block 35 fixed to swaying plate 34. In this case, limiting block 35 is in the holding position holding locking member 36 in its upper, unlocking position (FIGS. 3 and 12), and wider section 369 of guide piece 364 of locking member 36 is received in second, smaller end 353 of guide groove 356 of limiting block 35. Furthermore, guide grooves 363 of locking member 36 are aligned with extensions 323 of follower 32 (FIG. 11). Further, linking rod 730 is in its first limit position (FIG. 3). Specifically, protrusion 742 of linking rod 730 is aligned with but outside of groove 366 (FIG. 11), and limiting pin 44 is in front end 746 of slot 744. In this state, latch 38 can be pivoted about first axis X from the extended, latching position to the retracted, unlatching position.

When closing door 1, third face 386 of latch 38 is pressed against by stop 12 and, thus, pivots inward from the extended, latching position to the retracted, unlatching position. Follower 32 pivots inward together with latch 38 so that extensions 323 of follower 32 are extended through and engaged with guide grooves 363 of locking member 36. Pivotal movement of follower 32 also causes movement of limiting pin 44 in the unlatching direction away from latch 38, which, in turn, moves linking rod 730 in the unlatching direction away from latch 38 so that protrusion 742 of linking rod 730 is moved into and engaged with groove 366 of locking member 36.

Lateral wings 751 push first and second connecting arms 152 to pivot, actuating first and second sliding blocks 142 to move toward linking rod 730 along first axis X, which, in turn, causes top latch head 907 and bottom latch head 909 to retract together with latch 38. After door 1 is completely closed, latch 38 returns to its latching position (FIG. 16A) and is stopped by stop 12. Top latch head 907 and bottom latch head 909 extend outward and are stopped by stops on upper and lower ends of door frame 11 (FIG. 16), avoiding door 1 from being opened.

Figure 18:
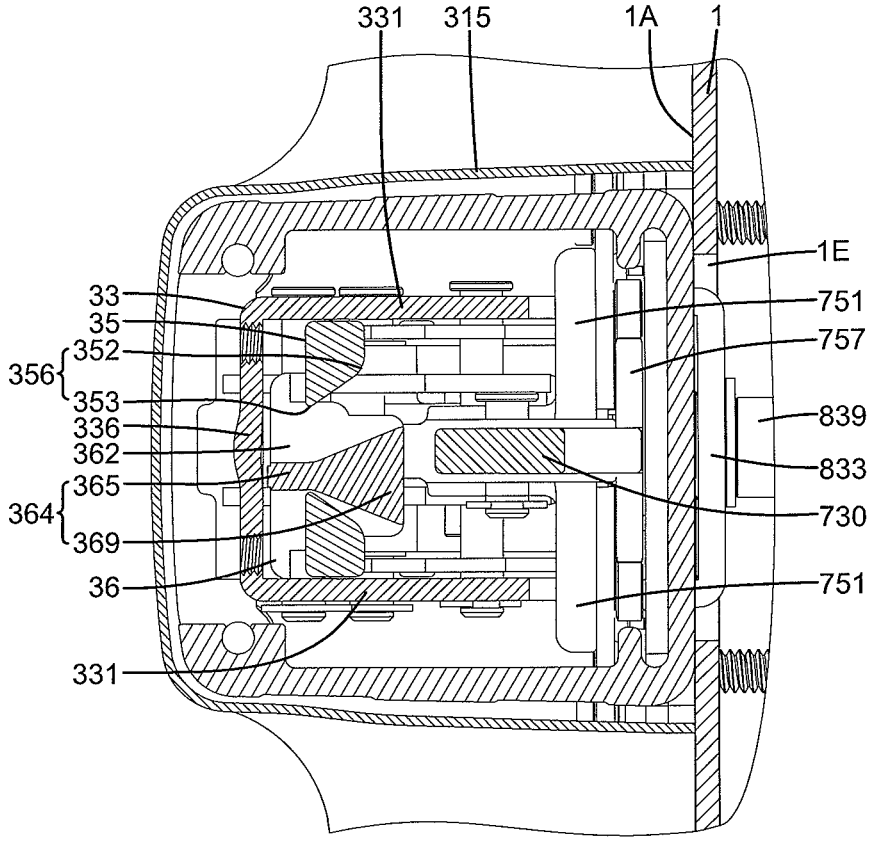
FIG. 18 shows a cross sectional view taken along section line 18-18 of FIG. 17.

When door 1 is completely closed (FIG. 16A), first ends 341 of first and second side boards 345 of swaying plate 1 are pressed against and retained in place by stop 12 in the inner, second position. Limiting block 35 is retained in the releasing position. Note that locking member 36 is no longer restrained by limiting block 35, for the second, smaller end 353 of guide groove 356 is aligned with and receives narrower section 365 of guide piece 364 of locking member 36. Protrusion 742 of linking rod 730 disengages from groove 366 of locking member 36. Thus, locking member 36 is released from protrusion 742 and moves downward along guide pin 43 (along first axis X) under the action of gravitational force to the lower, locking position resting on an inner face of second sidewall 331 (FIGS. 17 and 18). As a result, guide grooves 363 of locking member 36 no longer align with extensions 323 of follower 32 (extensions 323 now abut front face 361 of locking member 36). Namely, when door 1 is completely closed, pivotal movement of latch 38 from the extended, latching position to the retracted, unlatching position is prevented, for the follower 32 that pivots together with latch 38 can not pivot inward due to the fact that extensions 323 of follower 32 are not aligned with and, thus, can not pivot into guide grooves 363 of locking member 36. In this case, protrusion 742 of linking rod 730 is not aligned with and outside of groove 366 of locking member 36. Furthermore, protrusion 742 of linking rod 730 abuts against a wall portion of end opening 368 (FIG. 17).

Figure 19:
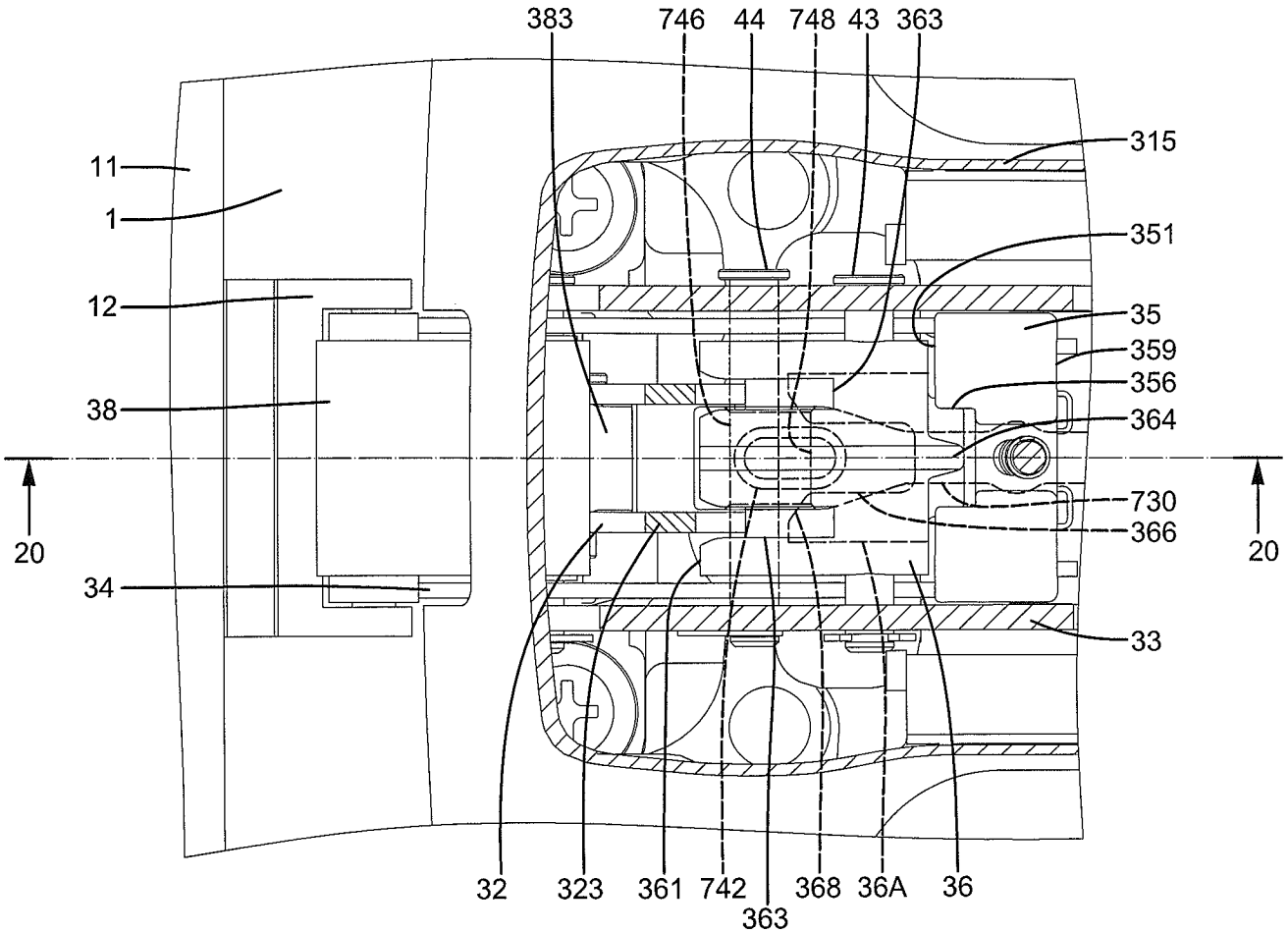
FIG. 19 shows a view similar to FIG. 17, with the connecting rod moved to a second limit position, with a locking member in an unlocking position.
Figure 22:
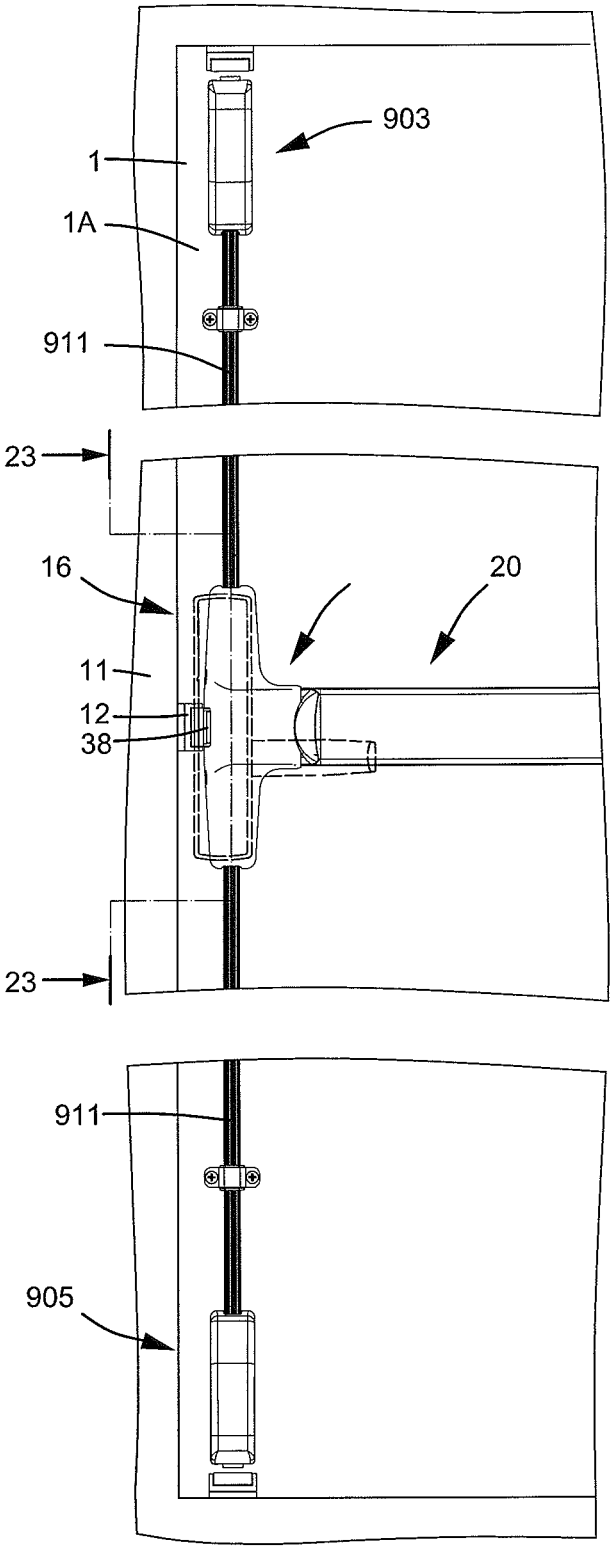
FIG. 22 shows a view similar to FIG. 16, with a latch pivoted to the retracted, unlatching position, with top and bottom latch heads retracted.
Figure 23:
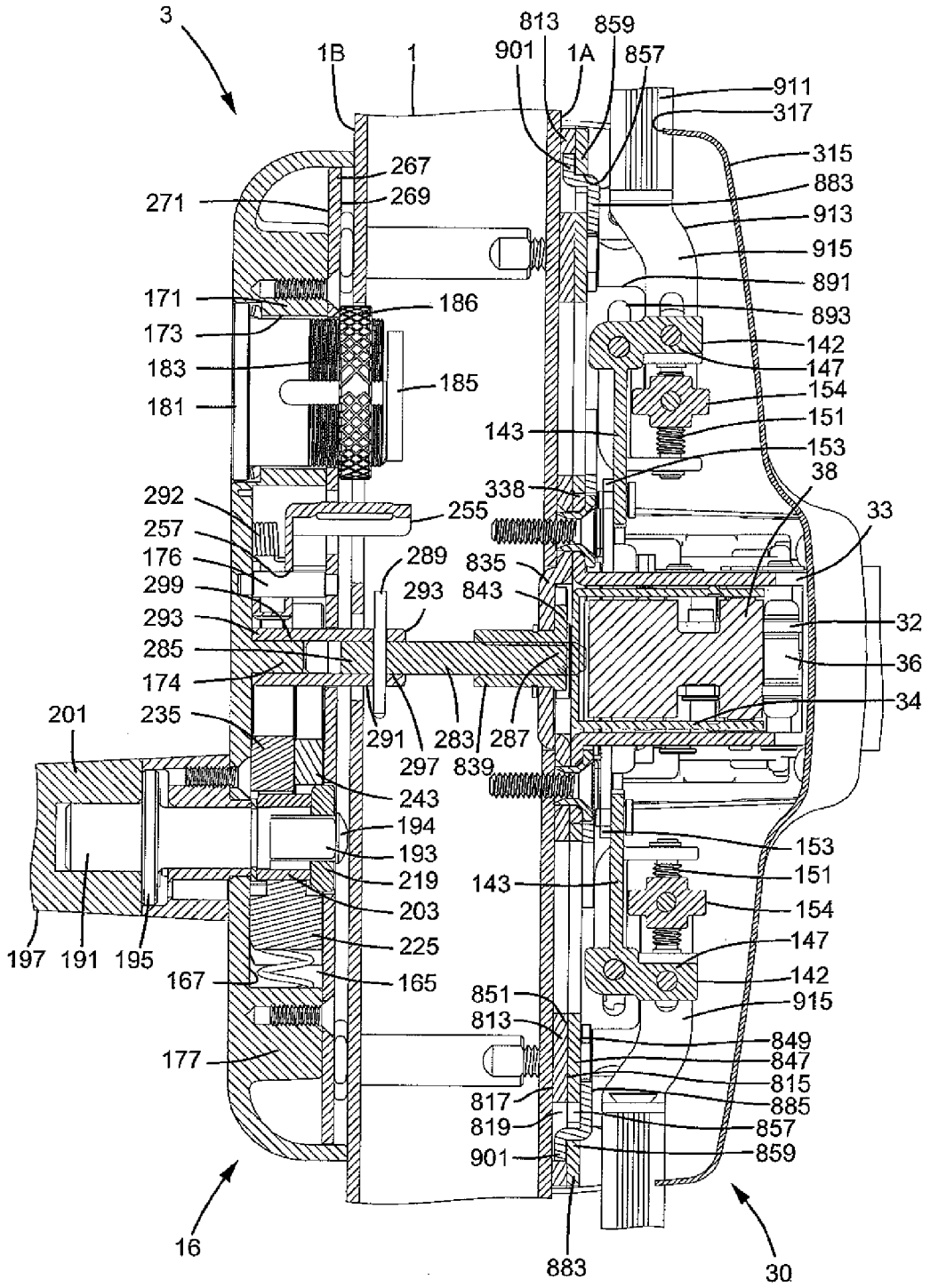
FIG. 23 shows a cross sectional view taken along section line 23-23 of FIG. 22.

When opening of door 1 is desired, operative member 688 is pressed to an extent to actuate pull mechanism 400 and linking rod 730 to move jointly in the latching direction along second axis Y. Linking rod 730 moves through its idle travel equal to the length of slot 744 without moving limiting pin 44 and follower 32. During the idle travel of linking rod 730, protrusion 742 of linking rod 730 moves through end opening 368 into groove 366 of locking member 36 (FIGS. 19 and 20) and moves locking member 36 upward along guide pin 43 to the upper, unlocking position so that guide grooves 363 of locking member 36 are aligned with extensions 323 of follower 32. Note that limiting pin 44 is now in front end 746 of slot 744 of linking rod 730 (FIGS. 19 and 20). When operative member 688 is further pressed, linking rod 730 moves further in the unlatching direction to move limiting pin 44 in the unlatching direction. As a result, latch 38 pivots together with follower 32 to the retracted, unlatching position allowing opening of door 1 (FIG. 21). At the same time, lateral wings 751 of linking rod 730 pull second pivotal ends 155 of first and second connecting arms 152, causing pivotal movement of first pivotal ends 153 of first and second connecting arms 152. First and second sliding devices 14 are moved toward linking rod 730 along first axis X (FIGS. 2 and 3). Thus, top latch head 907 and bottom latch head 909 move inward together with latch 38, allowing opening of door 1 (FIG. 22).

Figure 25:
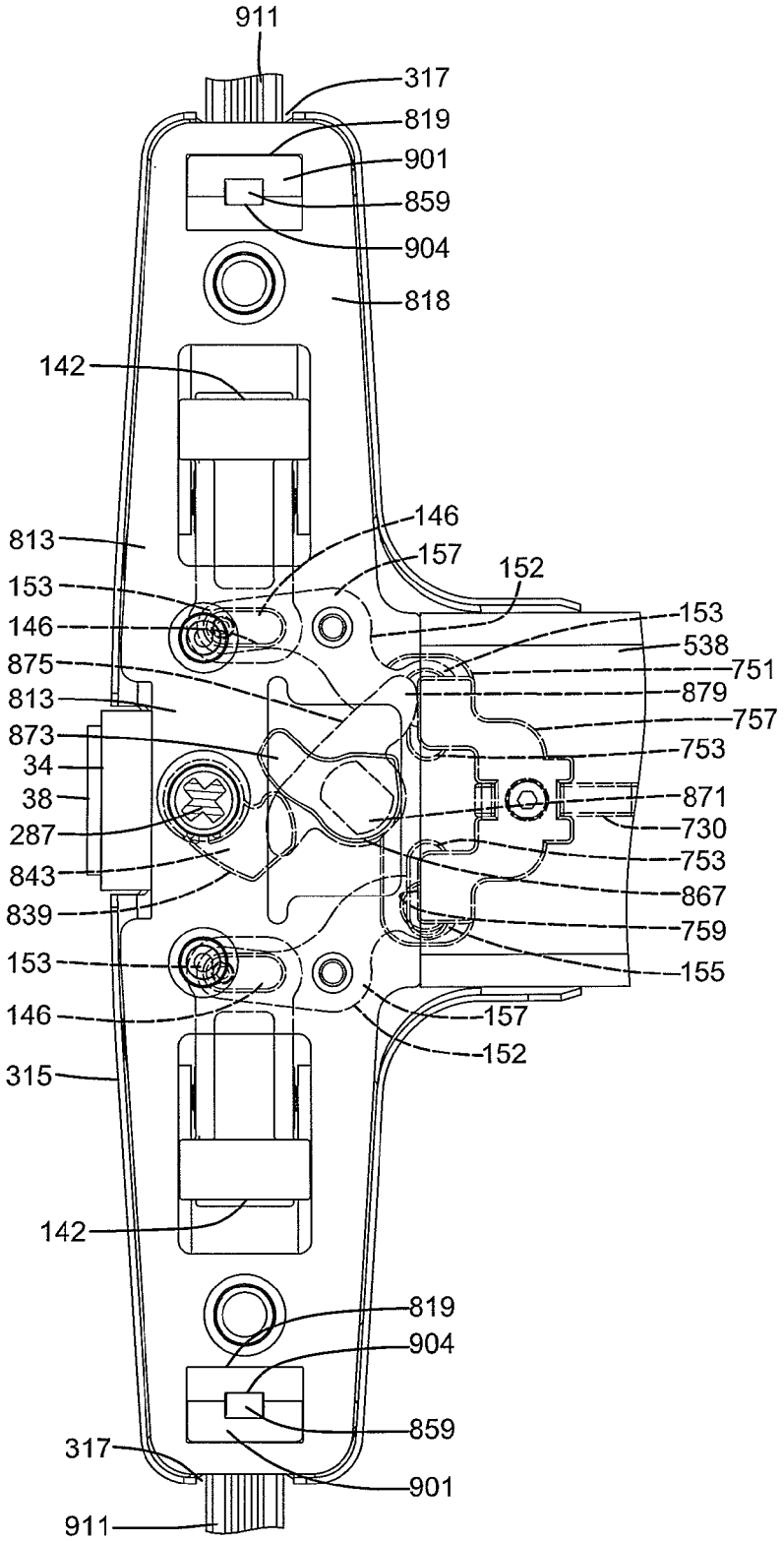
FIG. 25 shows a view similar to FIG. 10, with the handle rotated.
Figure 27:
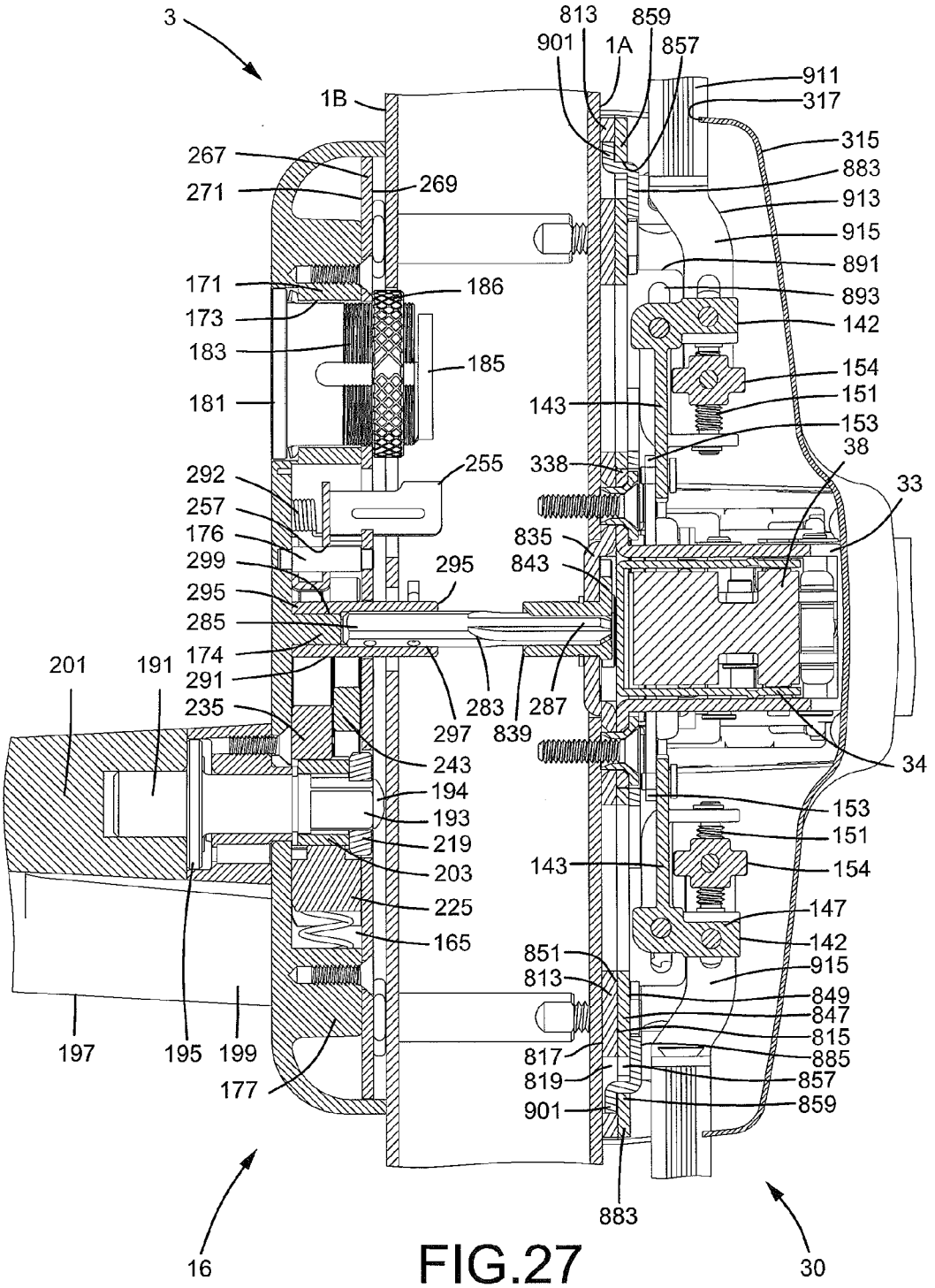
FIG. 27 shows a cross sectional view taken along section line 27-27 of FIG. 26.

If handle 197 of outer operational device 16 is pivoted from the first position to the second position, actuator 219 and push block 203 are also pivoted. Lower end 217 of one of push portions 213 of push block 203 presses against pressing block 225 along first axis X to compress spring 233 toward engagement portion 177 (FIG. 24). Upper end 215 of the other push portion 213 pushes movable block 243 to move from the releasing position to the pressing position along first axis X (FIG. 24). Groove 251 provides a room for sleeve 291 while movable block 243 moves from the releasing position to the pressing position. Protrusion 253 of movable block 244 presses against arm 301 of sleeve 291, causing sleeve 291 to pivot about the pivot axis defined by first peg 174. Follower rod 283 pivots together with sleeve 291 and drives connecting member 839 of latch device 30 to pivot. Cam 843 of connecting member 839 pushes tail 873 of driving member 867 to pivot. Thus, follower 875 and driving member 867 pivot jointly. One of protruded portions 879 of follower 875 pushes end face 759 of yoke 757, moving linking rod 730 in the unlatching position along second axis Y (FIG. 25). First and second sliding devices 14 move toward linking rod 730 along first axis X. When handle 197 reaches the second position (FIGS. 25, 26, and 27), movable block 243 is in the pressing position (FIG. 24). First and second sliding devices 14 are near linking rod 730 (FIGS. 25 and 27). Latch 38 is in the unlatching position. Top latch head 907 and bottom latch head 909 are retracted (FIG. 26), allowing opening of door 1.

When door 1 is closed (FIG. 16A) and positioning block 235 is in the upper position (FIG. 15), if actuating plate 185 of cylinder 181 is pivoted, second stop 261 of actuating member 255 is actuated by actuating plate 185, causing pivotal movement of actuating member 255. Engagement plate 263 of actuating member 255 moves from the upper position to the lower position (FIG. 28), engaging positioning portion 237 of positioning block 235 with positioning groove 207 of push block 203, preventing pivotal movement of push block 203, actuator 219, and spindle 191. Thus, handle 197 can not be moved from the first position to the second position, locking outer operational device 16. Since actuator 219 is coupled with push block 203 for joint movement by teeth 223, when push block 203 is positioned by positioning block 235 (and, hence, cannot pivot), handle 197 cannot move push block 203. In this case, teeth 223 break if a large force is applied to handle 197. Thus, handle 197 pivot freely without actuating push block 203, preventing outer operational device 16 in the locking state from being damaged. Thus, by using actuator 219 to engage with handle 197 and push block 203, damage to interior parts of outer operational device 16 is avoided even if handle 197 is forcibly pivoted. Furthermore, since movement of handle 197 cannot pivot follower rod 283, latch 38 will not move to the latching position, enhancing the burglarproof effect.

Figure 15:
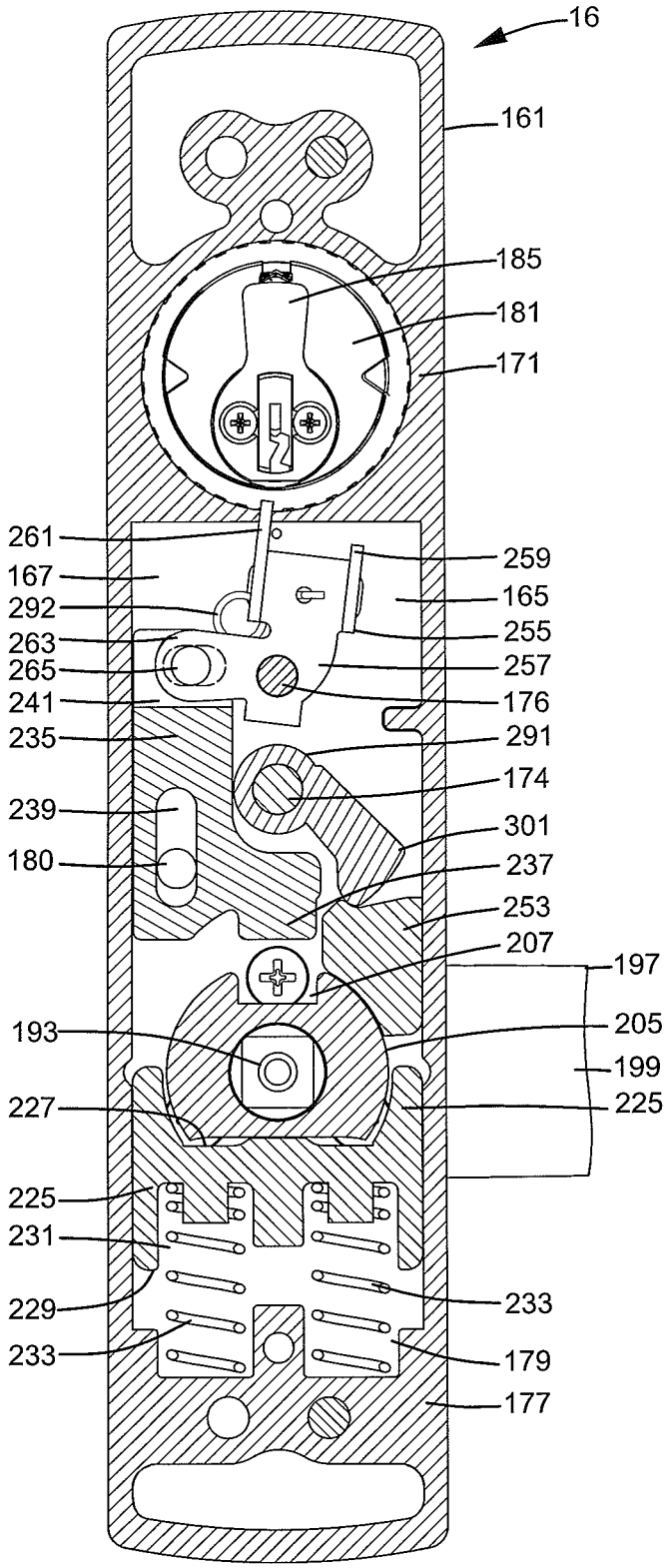
FIG. 15 shows a cross sectional view taken along section line 15-15 of FIG. 8.

If actuating plate 185 of cylinder 181 is further pivoted while outer operational device 16 is in the locking state, actuating plate 185 presses against first stop 259 of actuating member 255. Pivotal movement of actuating member 255 causes movement of positioning block 235 from the lower position (FIG. 28) to the upper position (FIG. 15). Outer operational device 16 is, thus, unlocked.

Base 811 of latch device 30 of door lock 3 is comprised of first, second, and third plates 813, 847, and 883 to overcome the limitation of conventional sheet metal processing on a small plate. Namely, conventional sheet metal processing can be used such that base 811 has sufficient structural strength while having a smaller volume. The overall volume of latch device 30 can be reduced without sacrificing the structural strength.

Now that the basic teachings of the present invention have been explained, many extensions and variations will be obvious to one having ordinary skill in the art. For example, latch device 30 does not have to include swaying plate 34, limiting block 35, locking member 36, guide rod 39, and spring 393. Follower 32 does not have to include extensions 323. Further, first and second sliding devices 14 of latch device 30 do not have to connect with top latch 903 and bottom latch 905. In this case, when door 1 is closed, latch 38 is still stopped by stop 12 to prevent door 1 from being opened. Further, outer operational device 16 does not have to include lid 267 without the risk of falling of the interior parts of outer operational device 16, because the end face of housing 161 abuts second side 1B of door 1. Further, push block 203 can include only one insertion groove 211, and actuator 219 can include only one tooth 223. Further, actuating member 255 can include only one an engagement plate 263.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising, in combination:

a latch device adapted to be fixed to a first side of a door, with the latch device including a latch pivotable about a first axis between an extended, latching position and a retracted, unlatching position, wherein when the door is in a closed position and the latch is in the extended, latching position, the door is retained in the closed position, and when the door is in the closed position and the latch is in the retracted, unlatching position, the door is moveable from the closed position to an open position;

a housing including an end face defining a space, with the space including a bottom wall, with a receiving portion formed on the bottom wall, with a receiving hole defined in the receiving portion and in communication with the space and an outside, with the housing further including first and second pegs and an engagement hole, with the first peg located between the second peg and the engagement hole along the first axis, with the housing adapted to be mounted to the door, with the end face of the housing adapted to abut a second side of the door opposite to the first side of the door;

a cylinder mounted in the receiving hole of the receiving portion, with the cylinder including an actuating plate rotatably received in the space of the housing;

a spindle pivotably received in the engagement hole of the housing, with the spindle including an engagement end received in the space of the housing;

a handle mounted to the spindle and located outside of the housing, with the handle pivotable between a first position and a second position, with the spindle pivoting jointly with the handle;

a push block pivotably connected to the spindle, with the push block including a peripheral wall having a positioning groove, with the push block further including two push portions formed on an outer periphery of the push block, with the positioning groove located between the two push portions in a circumferential direction about a pivot axis of the spindle, with each of the two push portions including upper and lower ends spaced from each other along the first axis, with a connection hole extending from a side through another side of the push block and including an inner periphery having an insertion groove, with the engagement end of the spindle pivotably received in the connection hole of the push block;

an actuator coupled to and pivotable together with the spindle, with an actuation hole extending from a side through another side of the actuator, with a tooth formed on the other side of the actuator and engaged in the insertion groove of the push block, with the engagement end of the spindle engaged with the actuation hole of the actuator, with the spindle pivotable together with the actuator;

a positioning block received in the space of the housing and movable between an upper position and a lower position along the first axis, with the positioning block including upper and lower ends spaced from each other along the first axis, with the upper end of the positioning block including a coupling portion, with the lower end of the positioning block having a positioning portion, wherein when the handle is in the first position, the positioning portion of the positioning block is aligned with the positioning groove of the push block along the first axis;

an actuating member pivotably received in the space of the housing, with the actuating member including a pivotal portion pivotably connected to the second peg of the housing, with the actuating member further including an engagement plate pivotably engaged with the coupling portion of the positioning block, with first and second stops formed on two sides of the pivotal portion, with the actuating plate of the cylinder pressing against one of the first and second stops when the actuating plate pivots;

a movable block slideably received in the space of the housing, with the movable block including first and second surfaces spaced from each other, with the movable block further including a lower surface extending between the first and second surfaces, with a protrusion formed on the second surface of the movable block and located adjacent to the lower surface of the movable block, with the second surface abutting the positioning block, with the protrusion spaced from the positioning block along a second axis perpendicular to the first axis, with the movable block movable along the first axis between a releasing position and a pressing position, wherein when the movable block is in the releasing position, the lower surface of the movable block abuts the upper end of each of the two push portions of the push block;

a sleeve pivotably connected to the housing, with the sleeve including a first end pivotably connected to the first peg of the housing and a second end, with the sleeve further including an arm formed on an outer periphery of the sleeve, with the arm having a distal end abutting the protrusion of the movable block, wherein when the movable block moves, the protrusion of the movable block presses against the arm of the sleeve, causing pivotal movement of the sleeve about a pivot axis defined by the first peg; and a follower rod coupled to the second end of the sleeve, with the follower rod pivotable together with the sleeve, with the follower rod including an end connected to and movable with the latch device, with the latch pivoting between the extended, latching position and the retracted, unlatching position when the follower rod pivots;

wherein when the actuating plate of the cylinder pivots and presses against the first stop of the actuating member, the actuating member moves jointly with the positioning block from the lower position to the upper position, wherein when the positioning block is in the upper position and when the actuating plate of the cylinder pivots and presses against the second stop of the actuating member, the actuating member moves jointly with the positioning block from the upper position to the lower position, wherein when the positioning block is in the lower position and when the handle is in the first position, the positioning portion of the positioning block is engaged with the positioning groove of the push block, preventing the push block from pivoting from the first position to the second position, and avoiding the latch from moving from the extended, latching position to the retracted, unlatching position, wherein when the positioning block is in the upper position, the positioning portion of the positioning block is disengaged from the positioning groove of the push block, and the handle is movable from the first position to the second position, when the handle pivots from the first position to the second position, the tooth of the actuator presses against the push block, causing joint pivotal movement of the actuator and the push block, and the upper end of one of the two push portions of the push block presses against the lower surface of the movable block, moving the movable block from the releasing position to the pressing position, wherein the protrusion of the movable block pushes the follower rod to pivot through transmission of the sleeve, wherein the follower rod moves the latch from the extended, latching position to the retracted, unlatching position, wherein when the handle is in the second position, the movable block is in the pressing position, the latch is in the retracted, unlatching position, wherein when the positioning block is in the lower position, the positioning portion of the positioning block is engaged with the positioning groove of the push block, and when the tooth breaks due to forcible pivotal movement of the handle, pivotal movement of the spindle causes pivotal movement of the actuator without moving the push block.

2. The door lock as claimed in claim 1, with the housing further including an engagement portion on the bottom wall, with the engagement hole located between the first peg and the engagement portion along the first axis, with the door lock further comprising:

a pressing block slideably received in the space of the housing, with the pressing block including upper and lower faces spaced from each other along the first axis, with the pressing block located between the engagement portion and the push block along the first axis; and a spring mounted between the pressing block and the engagement portion, with the spring biasing the pressing block towards the push block along the first axis, with the upper face of the pressing block pressing against the lower ends of the two push portions of the push block, wherein when the handle pivots from the first position to the second position by an external force, the lower end of one of the two push portions of the push block moves the pressing block towards the engagement portion along the first axis and compresses the spring, wherein when the external force applied to the handle vanishes, the spring biases the pressing block to move towards the spindle along the first axis, pivoting the push block and returning the handle to the first position.

3. The door lock as claimed in claim 1, further comprising:

a first plate formed by sheet metal processing, with the first plate including first and second faces spaced from each other along a third axis perpendicular to the first and second axes, with the first plate further including upper and lower portions spaced from each other along the first axis, with a through-opening extending from the first face through the second face of the first plate and located between the upper and lower portions, with the first plate further including a pivotal portion located between the upper and lower portions and located at a side of the through-opening, with the pivotal portion of the first plate including a shaft hole, with the first plate adapted to be mounted to the first side of the door;

a connecting member pivotably mounted to the first plate, with the connecting member including a shaft and a cam on an outer periphery of the shaft, with the connecting member further including a connection hole on an end face of the shaft, with the shaft pivotably received in the shaft hole of the first plate, with the cam located between the pivotal portion and the first face of the first plate, with the follower rod engaged with the connection hole of the connecting member, with the follower rod pivotable together with the connecting member;

a second plate formed by sheet metal processing, with the second plate mounted to the first face of the first plate, with the second plate including two wings spaced along the first axis, with the second plate further including first and second surfaces spaced from each other along the third axis, with a knob hole extending from the first surface through the second surface of the second plate and located between the two wings, wherein the second surface of the second plate abuts the first face of the first plate, with the pivotal portion of the first plate including an inner face spaced from the second surface of the second plate along the third axis;

a driving member pivotably mounted to the second plate, with the driving member including a knob having a driving end, with a tail extending from an outer periphery of the knob, with the knob of the driving member pivotably received in the knob hole of the second plate, with the tail located between the second surface of the second plate and the inner face of the pivotal portion of the first plate, with the tail abutting the cam, with the driving end of the knob extending beyond the first surface of the second plate, wherein pivotal movement of the cam actuated by the connecting member causes pivotal movement of the tail of the driving member;

a follower mounted to the driving member, with the follower including a receiving portion having an actuation hole, with two protruded portions formed on an outer periphery of the receiving portion, with the follower located on the first surface of the second plate, with the driving end of the knob of the driving member engaged in the actuation hole of the follower, with the follower pivotable together with the driving member;

a bracket fixed to the first surface of the first plate, with the latch pivotably received in the bracket, with the latch adapted to cooperate with a stop of a door frame to which the door is pivotably mounted, wherein when the door is closed and the latch is in the extended, latching position, the latch is stopped by the stop to prevent the door from being opened, wherein when the latch is in the retracted, unlatching position, the door is openable;

a follower including first and second ends spaced from each other along the first axis, with the first end of the follower pivotably connected to the latch by a pivot;

a linking rod including first and second ends spaced from each other along second axis, with the linking rod further including a lateral face extending between the first and second ends, with the first end of the linking rod pivotably connected to the second end of the follower, with the second end of the linking rod operatively connected to an inner operational device having an operative member, wherein when the operative member is pressed, the linking rod is moved along the second axis to move the latch from the extended, latching position to the retracted, unlatching position; and a yoke fixed to the lateral face of the linking rod, with the yoke including an end face, with one of the two protruded portions of the follower pressing against the end face of the yoke when the follower pivots, causing joint movement of the yoke and the linking rod along the second axis to pivot the latch;

wherein when the handle pivots about the pivot axis defined by the spindle, the follower rod and the connection member pivot jointly, and the cam of the connection member presses against the tail to pivot the driving member, wherein the follower presses against the end face of the yoke, causing movement of the linking rod along the second axis to move the latch from the extended, latching position to the retracted, unlatching position.

4. The door lock as claimed in claim 3, with the first plate further including two slots extending from the first face through the second face of the first plate, with the two slots spaced from each other along the first axis, with the second plate further including two slots extending from the first surface through the second surface of the second plate, with the two slots of the second plate respectively located in the two wings, with each of the two slots of the second plate including a tooth on a wall thereof, with each of the two slots of the second plate aligned with one of the two slots of the first plate, with the linking rod further including upper and lower faces spaced from each other along the first axis, with a lateral wing provided on each of the upper and lower faces of the linking rod and located on the first end of the linking rod, with each of the lateral wings including a slot, with the door lock further comprising:

two third plates formed by sheet metal processing and fixed to the first surface of the second plate, with each of the two third plates including first and second sides spaced from each other along the third axis, with two support plates formed on the first side of each of the two third plates and spaced from each other along the second axis, with each of the two support plates including a movement groove, with a retaining portion formed on the second side of each of the two third plates and including a first section and a second section, with the first section of each of the retaining portions including a retaining hole, with each of the two third plates mounted to one of the two wings of the second plate and located on the first surface of the second plate, with the retaining portion of each of the two third plates engaged in one of the slots of the second plate, with each of the teeth of the second plate engaged in the retaining hole of one of the two third plates, with the second section of each of the retaining portions received in one of the two slots of the first plate;

first and second sliding blocks respectively and slideably engaged with the two third plates, with each of the first and second sliding blocks including a seat having a sliding groove, with a pivotal block and a support formed on the seat of each of the first and second sliding blocks, with the support located between the pivotal block and the sliding groove, with the pivotal block of each of the first and second sliding blocks including an axial hole, with the support of each of the first and second sliding blocks including a support hole aligned with the axial hole, with each of the first and second sliding blocks further including a pivot hole extending along the second axis;

two mounting rods, with each of the two mounting rods extending through the movement grooves of one of the two third plates and the pivot hole of one of the first and second sliding blocks, with each of the first and second sliding blocks movable along the first axis between the support plates of one of the two third plates;

first and second connecting arms pivotably and respectively connected to the first sides of the two third plates, with each of the first and second connecting arms including first and second pivotal ends and a pivotal portion between the first and second pivotal ends, with the pivotal portion of each of the first and second connecting arms pivotably connected to one of the two third plates, with the first pivotal end of each of the first and second connecting arms pivotably connected to the slot of one of the lateral wings of the linking rod, with the second pivotal end of each of the first and second connecting arms pivotably connected to the sliding groove of one of the first and second sliding blocks;

two adjusting rods, with each of the two adjusting rods pivotably received in the axial hole and the support hole of the support of one of the first and second sliding blocks; and two adjusting blocks threadedly engaged with the two adjusting rods, respectively, with each of the two adjusting blocks located between the pivotal block and the support of one of the first and second sliding blocks, with one of the two adjusting blocks adapted to be operatively connected to a top latch head of a top latch mounted to the door, with another of the two adjusting blocks adapted to be operatively connected to a bottom latch head of a bottom latch mounted to the door, wherein when the first and second sliding blocks move toward the linking rod along the first axis, the top and bottom latch heads move to a retracted position allowing opening of the door.

* * * * *